US009084066B2

(12) United States Patent
De Vries et al.

(10) Patent No.: US 9,084,066 B2
(45) **Date of Patent: *Jul. 14, 2015**

(54) OPTIMIZATION OF HEARING AID PARAMETERS

(75) Inventors: Aalbert De Vries, Eindhoven (NL); Alexander Ypma, Veldhoven (NL)

(73) Assignee: GN RESOUND A/S, Ballerup (DK)

( * ) Notice: Subject to any disclaimer, the term of this patent is extended or adjusted under 35 U.S.C. 154(b) by 1624 days.

This patent is subject to a terminal disclaimer.

(21) Appl. No.: 12/090,232

(22) PCT Filed: Oct. 13, 2006

(86) PCT No.: PCT/DK2006/000577

§ 371 (c)(1),
(2), (4) Date: Sep. 17, 2009

(87) PCT Pub. No.: WO2007/042043

PCT Pub. Date: Apr. 19, 2007

(65) Prior Publication Data

US 2010/0008526 A1 Jan. 14, 2010

Related U.S. Application Data

(60) Provisional application No. 60/727,526, filed on Oct. 17, 2005, provisional application No. 60/785,581, filed on Mar. 24, 2006.

(30) Foreign Application Priority Data

Oct. 14, 2005 (DK) ..... 2005 01440
Mar. 24, 2006 (DK) ..... 2006 00424

(51) Int. Cl.
*H04R 25/00* (2006.01)

(52) U.S. Cl.
CPC ..... *H04R 25/70* (2013.01)

(58) Field of Classification Search
None
See application file for complete search history.

(56) References Cited

U.S. PATENT DOCUMENTS 5,754,661 A * 5/1998 Weinfurtner ..... 381/316
6,035,050 A * 3/2000 Weinfurtner et al. ..... 381/313
6,148,274 A * 11/2000 Watanabe et al. ..... 703/6

(Continued)

FOREIGN PATENT DOCUMENTS

DE 10053179 A1 5/2001
EP 1367857 A1 12/2003

(Continued)

OTHER PUBLICATIONS

J. Christopher Westland, "Bayesian Alternatives to Neural Computing", Published in: IEEE Transactions on Systems, Man, and Cybernetics, vol. 25, No. 1, Jan. 1995.*

(Continued)

*Primary Examiner* — Duc Nguyen
*Assistant Examiner* — Taunya McCarty
(74) *Attorney, Agent, or Firm* — Vista IP Law Group, LLP

(57) ABSTRACT

The present invention relates to a new method for effective estimation of signal processing parameters in a hearing aid. It is based on an interactive estimation process that incorporates—possibly inconsistent—user feedback. In particular, the present invention relates to optimization of hearing aid signal processing parameters based on Bayesian incremental preference elicitation.

53 Claims, 13 Drawing Sheets

(56) References Cited

U.S. PATENT DOCUMENTS

Figure 1:
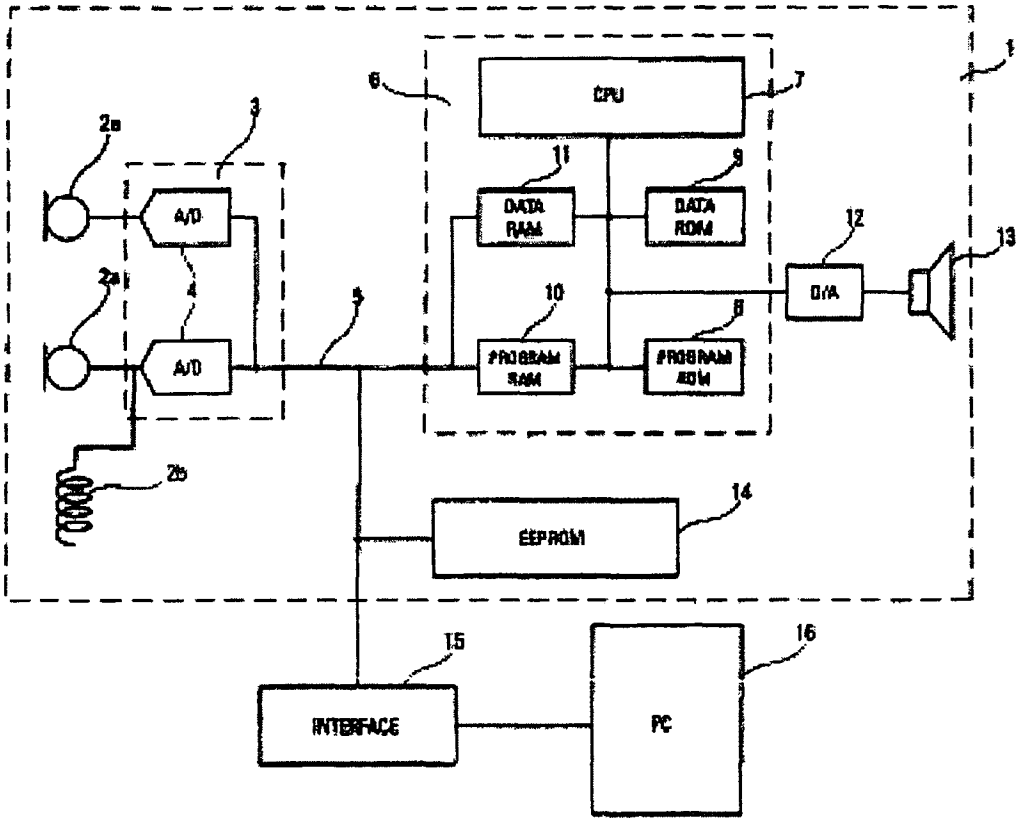

| | | | | |
|---|---|---|---|---|
| 6,850,775 | B1 * | 2/2005 | Berg | 455/556.1 |
| 7,031,481 | B2 * | 4/2006 | Mortensen | 381/312 |
| 7,415,120 | B1 * | 8/2008 | Vaudrey et al. | 381/109 |
| 2001/0055404 | A1 | 12/2001 | Bisgaard | |
| 2003/0059076 | A1 | 3/2003 | Martin | |
| 2003/0112988 | A1 | 6/2003 | Naylor | |
| 2003/0133578 | A1 * | 7/2003 | Durant | 381/60 |
| 2004/0047474 | A1 * | 3/2004 | Vries et al. | 381/60 |
| 2004/0190739 | A1 | 9/2004 | Bachler et al. | |
| 2004/0208331 | A1 * | 10/2004 | Chalupper | 381/314 |
| 2005/0088981 | A1 * | 4/2005 | Woodruff et al. | 370/260 |
| 2006/0182295 | A1 * | 8/2006 | Dijkstra et al. | 381/315 |
| 2007/0076909 | A1 * | 4/2007 | Roeck et al. | 381/312 |

FOREIGN PATENT DOCUMENTS

| | | | |
|---|---|---|---|
| WO | 9827787 | A1 | 6/1998 |
| WO | WO 2004114722 | A1 * | 12/2004 |
| WO | 2007042043 | A3 | 4/2007 |

OTHER PUBLICATIONS

Eric Bauer, Daphne Koller, and Yoram Singer, "Update rules for parameter estimation in Bayesian networks", Published in Proceedings of the Thirteenth conference on Uncertainty in artificial intelligence (UAI 1997), San Francisco, CA, USA, pp. 3-13.*

International Search Report and Written Opinion for PCT/DK2006/000577.

Nix, et al. "Statistics of Binaural Parameters and Localization in Noise" World Scientific, (2000).

International Preliminary Report for PCT/DK2006/000577.

MacKay, D.J.C. "Information Theory, Inference, and Learning Alborithms" Cambridge University Press, 2003, v7.2 (fourth print., Mar. 28, 2005), pp. 379-628.

Penny, W. D. "Signal Processing Course" Apr. 28, 2000, pp. 1-177.

English abstract of German Patent No. 10053179 (cited in the Danish Search Report dated May 23, 2006 for PA200501440).

Kates, J.M. et al."Coherence and the speech intelligibility index", J. Acoust. Soc. Am., Apr. 2005, 117(4):2224-2237.

Minka, T. P. "From Hidden Markov Models to Linear Dynamical Systems" 1999, pp. 1-10.

MacKay, D.J.C. "Information Theory, Inference, and Learning Alborithms" Cambridge University Press, 2003, v7.2 (fourth print., Mar. 28, 2005), Title page, copyright page, Table of Contents and pp. 1-378.

English Abstract of German Patent No. 10053179 (cited in the Danish Search Report dated May 23, 2006 for PA 200501440).

W.D. Penny, "Kalman Filters", Signal Processing Course, Apr. 2000, pp. 127-138.

Danish Search Report dated May 23, 2006 for PA200501440.

English Abstract of German Patent No. DE 10053179, publication date May 10, 2001 (cited in the Danish Search Report dated May 23, 2006 for PA 200501440).

* cited by examiner

Algorithm 1 Bayesian Incremental Fitting (BI-FIT) Algorithm

Given: algorithm library $F(x, \Theta)$ and (audio) database $\mathcal{X}$
Also given: utility $U(y; \omega)$ and prior $P(\omega|\alpha)$
Measure patient's auditory profile $\alpha = \alpha_0$
$\theta_0^* = \arg\max_\theta \sum_n P(x_n) \int_\omega U(x_n; \theta, \omega)\, P(\omega|\alpha_0) d\omega$
repeat
  $e^k = \arg\max_e \mathrm{VPI}^k(e)$
  $P(\omega|D^k, \alpha_0) \propto P(d^k|e^k, \omega)\, P(\omega|D^{k-1}, \alpha_0)$
  $\theta_k^* = \arg\max_\theta \sum_n P(x_n) \int_\omega U(x_n; \theta, \omega)\, P(\omega|D^k, \alpha_0) d\omega$
  $k = k + 1$
until patient satisfaction
return best fit $\theta = \theta_k^*$

Fig. 3

Algorithm 2 Bayesian Incremental Personalization (BI-PER)

1: Given: algorithm $F(x, \Theta)$, utility $U(y; \omega)$ and prior $P(\omega | D^{k-1}, \alpha_0)$
2: repeat
3: nature selects $e^k$; record patient preference $d^k$
4: $P(\omega | D^k, \alpha_0) \propto P(d^k | e^k, \omega)\, P(\omega | D^{k-1}, \alpha_0)$
5: update best fit: $\theta_k^* = \arg\max_\theta \sum_n P(x_n) \int_\omega U(x_n; \theta, \omega)\, P(\omega | D^k, \alpha_0) d\omega$
6: $k = k + 1$
7: until forever

Fig. 4

Top: User amplification preference, Middle: user inconsistency, Bottom: inferred learning rate.

Without learning. Top: realised output signal $y_t$ and desired output signal (both in log-RMS). Middle: $\theta_k$. Bottom: volume adjustments applied by the virtual user.

Learning Volume Control. Graphs as in figure 3.

nLMS learning volume control with fast responce ($\mu$ = 0.9, $\gamma$ = 0.9). Top: noisy correction sequence {$e_K$}, Middle: inconsistency $\sigma_K$, Bottom: learning rate $\mu_K$.

Enhanced Kalman filter LVC. Top: user inconsistency $\sigma_k^2$. Bottom: learning rate $\mu_k$ (denoted with *alpha*).

Simplified Kalman filter LVC. Top: estimated state noise variance $\delta_k^2$. Middle: estimated user inconsistency $\sigma_k^2$. Bottom: estimated learning rate $\mu_k$ (denoted *alpha*).

OPTIMIZATION OF HEARING AID PARAMETERS

RELATED APPLICATION DATA

This application is a §371 National Stage application and a continuation of International Application No. PCT/DK2006/000577, which claims the benefit and priority to Danish Patent Application No. PA 2005 01440, filed on 14 Oct. 2005, and Danish Patent Application No. PA 2006 00424, filed on 24 Mar. 2006, and U.S. Provisional Patent Application No. 60/727,526, filed on 17 Oct. 2005, and U.S. Provisional Patent Application No. 60/785,581, filed on 24 Mar. 2006, the entire disclosure of all of which are expressly incorporated by reference herein.

The present invention relates to a new method for effective estimation of signal processing parameters in a hearing aid. It is based on an interactive estimation process that incorporates—possibly inconsistent—user feedback. In particular, the present invention relates to optimization of hearing aid signal processing parameters based on Bayesian incremental preference elicitation.

In a potential annual market of 30 million hearing aids, only 5.5 million instruments are sold. Moreover, one out of five buyers does not wear the hearing aid(s). Apparently, despite rapid advancements in Digital Signal Processor (DSP) technology, user satisfaction rates remain poor for modern industrial hearing aids.

Over the past decade, hearing aid manufacturers have focused on incorporating very advanced DSP technology and algorithms in their hearing aids. As a result, current DSP algorithms for industrial hearing aids feature a few hundred tuning parameters. In order to reduce the complexity of fitting the hearing aid to a specific user, manufacturers leave only a few tuning parameters adjustable and fix the rest to 'reasonable' values. Oftentimes, this results in a very sophisticated DSP algorithm that does not satisfactorily match the specific hearing loss characteristics and perceptual preferences of the user.

A hearing aid signal processing (algorithm) serves to restore normal loudness perception and improve intelligibility rates while keeping the distortion perceptually acceptable to the user. The tolerable amount and quality of signal distortion seems different for different users. In principle, proper hearing aid algorithm design requires an extensive individualized and perception driven tuning process.

Typically, today's design of hearing aid algorithms includes three consecutive stages: (1) DSP design, (2) audiological evaluation and (3) fitting. In the first stage, after many hours of arduous study of previous approaches, inspired fiddling with equations and trial-and-error prototyping, DSP engineers ultimately come up with a signal processing algorithm proposal. In the second stage, the proposed hearing aid algorithm is evaluated in a clinical trial that is generally conducted by professional audiologists. Typically, the results of the trial are summarized in a measure of statistical significance (e.g., based on p-values) that subsequently forms the basis for acceptance or rejection of the proposed algorithm. If the algorithm is rejected, the DSP design stage is repeated for provision of an improved algorithm. These first two stages take place within the hearing aid manufacturing company. After the hearing aid algorithm proposal passes the company audiological trials, the hearing aids are shipped to the dispenser's office where some final algorithm parameters are adjusted to fit the specific user (the so-called fitting stage).

While this design approach is widely used and has served the industry well, there are some obvious limitations. First, when a user walks around with a test hearing aid for a few weeks during an evaluation trial, many individual 'noteworthy' perceptual events occur. All these events for all subjects in the trial get averaged into a single (or a few) performance value(s) leading to a very large loss of information. Secondly, the outcome of the evaluation trials (measures of confidence and significance) forms the basis for rejection or acceptance of the algorithm, but rarely for improvement of the algorithm in a direct way.

It is an object of the present invention to provide a method for effective estimation of signal processing parameters in a hearing aid that is capable of incorporating user perception of sound quality over time.

It is a further object of the present invention to provide a method for providing a stimulus signal to present to the hearing aid user for provision of maximum information of user preferences.

According to the present invention, the above-mentioned and other objects are fulfilled by a method of automatic adjustment of at least one signal processing parameter $\theta \in \Theta$ in a hearing aid with a library of signal processing algorithms $F(\Theta)$, where $\Theta$ is the algorithm parameter space, the method comprising the steps of:

recording an adjustment made by the user of the hearing aid, and modifying the automatic adjustment of the at least one signal processing parameter $\theta \in \Theta$ in response to the recorded adjustment based on Bayesian incremental preference elicitation.

Bayesian inference involves collecting evidence that is meant to be consistent or inconsistent with a given hypothesis. As evidence accumulates, the degree of belief in a hypothesis changes. With enough evidence, it will often become very high or very low.

Bayesian inference uses a numerical estimate of the degree of belief in a hypothesis before evidence has been observed and calculates a numerical estimate of the degree of belief in the hypothesis after evidence has been observed.

Bayes' theorem adjusts probabilities given new evidence in the following way:

$$P(H_0 \mid E) = \frac{P(E \mid H_0)P(H_0)}{P(E)}$$

where $H_0$ represents a hypothesis, called a null hypothesis that was inferred before new evidence, E, became available, $P(H_0)$ is called the prior probability of $H_0$, $P(E|H_0)$ is called the conditional probability of seeing the evidence E given that the hypothesis $H_0$ is true. It is also called the likelihood function when it is expressed as a function of $H_0$ given E, and P(E) is called the marginal probability of E: the probability of witnessing the new evidence E under all mutually exclusive hypotheses.

It can be calculated as the sum of the product of all probabilities of mutually exclusive hypotheses and corresponding conditional probabilities: $\Sigma P(E|H_i)P(H_i)$.

$P(H_0|E)$ is called the posterior probability of $H_0$ given E.

The factor $P(E|H_0)/P(E)$ represents the impact that the evidence has on the belief in the hypothesis. If it is likely that the evidence will be observed when the hypothesis under consideration is true, then this factor will be large. Multiplying the prior probability of the hypothesis by this factor would result in a large posterior probability of the hypothesis given the evidence. Under Bayesian inference, Bayes' theorem therefore measures how much new evidence should alter a belief in a hypothesis.

Multiplying the prior probability $P(H_0)$ by the factor $P(E|H_0)/P(E)$ will never yield a probability that is greater than 1. Since $P(E)$ is at least as great as $P(E \cap H_0)$, which equals $P(E|H_0)\ P(H_0)$, replacing $P(E)$ with $P(E \cap H_0)$ in the factor $P(E|H_0)/P(E)$ will yield a posterior probability of 1. Therefore, the posterior probability could yield a probability greater than 1 only if $P(E)$ were less than $P(E \cap H_0)$, which is never true.

The probability of E given $H_0$, $P(E|H_0)$, can be represented as a function of its second argument with its first argument held at a given value. Such a function is called a likelihood function; it is a function of $H_0$ given E. A ratio of two likelihood functions is called a likelihood ratio, $\Lambda$. For example, $$\Lambda = \frac{L(H_0 \mid E)}{L(\text{not } H_0 \mid E)} = \frac{P(E \mid H_0)}{P(E \mid \text{not } H_0)}$$

The marginal probability, $P(E)$, can also be represented as the sum of the product of all probabilities of mutually exclusive hypotheses and corresponding conditional probabilities:

$$P(E|H_0)P(H_0)+P(E|\text{not } H_0)P(\text{not } H_0).$$

As a result, Bayes' theorem can be rewritten:

$$P(H_0 \mid E) = \frac{P(E \mid H_0)P(H_0)}{P(E \mid H_0)P(H_0) + P(E \mid \text{not } H_0)P(E \mid \text{not } H_0)} = \frac{\Lambda P(H_0)}{\Lambda P(H_0) + P(\text{not } H_0)}$$

With two independent pieces of evidence $E_1$ and $E_2$, Bayesian inference can be applied iteratively. The first piece of evidence may be used to calculate an initial posterior probability, and use that posterior probability may the be used as a new prior probability to calculate a second posterior probability given the second piece of evidence.

Independence of evidence implies that $$P(E_1,E_2|H_0)=P(E_1|H_0)\times P(E_2|H_0)$$

$$P(E_1,E_2)=P(E_1)\times P(E_2)$$

$$P(E_1,E_2|\text{not } H_0)=P(E_1|\text{not } H_0)\times P(E_2|\text{not } H_0)$$

Bayes' theorem applied iteratively implies $$P(H_0 \mid E_1, E_2) = \frac{P(E_1 \mid H_0) \times P(E_2 \mid H_0)P(H_0)}{P(E_1) \times P(E_2)}$$

Using likelihood ratios, it is found that $$P(H_0 \mid E_1, E_2) = \frac{\Lambda_1 \Lambda_2 P(H_0)}{\Lambda_1 \Lambda_2 P(H_0) + P(\text{not } H_0)}$$

For more information on Bayes' theorem and Bayesian inference, c.f. "Information Theory, Inference, and Learning Algorithms" by David J. C. Mackay, Cambridge University Press, 2003.

Bayesian modelling relies on Bayes' rule of statistical inference:

$$P(\omega \mid D) = \frac{P(D \mid \omega)P(\omega)}{P(D)}$$

$$\text{posterior} = \frac{\text{likelihood} \times \text{prior}}{\text{evidence}}$$

where the normaliser equals $P(D)=\int P(D|\omega)P(\omega)d\omega$. Application of this rule can be looked upon as a general mechanism to combine prior knowledge $P(\omega)$ on the model parameters $\omega$ with the data likelihood $P(D|\omega)$ into a posterior distribution over the parameters after the data has been observed. Unfortunately, the normalising constant is often an intractable quantity. In these cases, approximate posteriors may be formulated that are tractable and informative. Note that full Bayesian inference leads to confidence levels on the parameters, rather than a point estimate. The Bayesian modelling approach comprises the following stages (c.f. "Information Theory, Inference, and Learning Algorithms" by David J. C. Mackay, Cambridge University Press, 2003): model fitting, model comparison, and prediction.

1. Model fitting: a set of model structures $\mathcal{H}=\{H_j\}$, $j=1, \ldots, M$ is defined. $H_i$ is assumed true, and model parameters $\omega$ is learned given data D:

$$P(\omega \mid D, H_i) = \frac{P(D \mid \omega, H_i)P(\omega \mid H_i)}{P(D \mid H_i)}$$

If full Bayesian inference of the posterior is troublesome or too time demanding the most probable a posteriori (MAP) parameters can be searched for:

$$\omega_{MAP} = \underset{\omega}{\operatorname{argmax}} P(\omega \mid D, H_i)$$

Note that the intractable normaliser does not have to be computed anymore. The maximum likelihood (ML) estimate is obtained if the prior is not taken into account.

2. Model comparison: Infer which model $H_i \in \mathcal{H}$ is most plausible given D:

$$P(H_i|D) \propto P(D|H_i)P(H_i).$$

Here, the evidence for the model is:

$$P(D|H_i)=\int P(D|\omega,H_i)P(\omega|H_i)d\omega$$

which does not depend on the model parameters (they are integrated out) but is a function of the model structure and the data only. It can be used to compare the suitability of different model structures for the data, e.g. should 4 or 5 hidden units be used in a neural network model.

3. Prediction: the predictions of each model are weighed with the likelihood of the model; all weighted predictions are summed. Proper Bayesian prediction uses all models ('hypothesis about the data') for the prediction and emphasizes models with higher model evidence. A proxy to this way of predicting is to choose the structure with highest evidence and use its MAP parameters in the prediction. This still bears some risk of over fitting, though this risk is diminished by using the evidence (that will penalise unsuitable model structures) and a prior.

It should be noted that Bayesian MAP is also considered a Bayesian method. With suitable choices for the prior, it can be shown that maximum likelihood is again a special case of Bayesian MAP, so Bayesian learning also comprises maximum likelihood learning.

The method according to the invention provides an integrated approach to algorithm design, evaluation and fitting, where user preferences for algorithm hypotheses are elicited in a minimal number of questions (observations). This integrated approach is based on the Bayesian approach to probability theory, which is a consistent and coherent theory for reasoning under uncertainty. Since perceptual feedback from listeners is (partially) unknown and often inconsistent, such a statistic approach is needed to cope with these uncertainties. Below, the Bayesian approach, and in particular the Bayesian Incremental Preference Elicitation approach, to hearing aid algorithm design will be treated in more detail.

A hearing aid algorithm F(.) is a recipe for processing an input signal x(t) into an output signal $y(t)=F(x(t);\theta)$, where $\theta\in\Theta$ is a vector of tuning parameters such as compression ratio's, attack and release times, filter cut-off frequencies, noise reduction gains etc. The set of all interesting values for $\theta$ constitutes the parameter space $\Theta$ and the set of all 'reachable' algorithms constitutes an algorithm library $F(\Theta)$. After a hearing aid algorithm library $F(\Theta)$ has been developed (usually by an algorithm DSP design group in a hearing aid company), the next challenging step is to find a parameter vector value $\theta^*\in\Theta$ that maximizes user satisfaction. In hearing aid parlance, this latter issue is called the fitting problem.

The extent of "user satisfaction" cannot be determined entirely through objective metrics such as signal-to-noise ratio or loudness. Assuming that there exists an 'internal' metric in a user's brain that corresponds to his appreciation of the received sound, this "sound quality" metric may be modelled by a user satisfaction or utility function $U(y;\omega)$, where y represents an audio signal and $\omega\in\Omega$ the tunable parameters of the utility model. The term "utility" is from Decision Theory terminology. Since $y=F(x;\theta)$, $U(y;\omega)=U(x;\theta,\omega)$. The last expression is useful, since it shows the implicit dependency of the utility on the hearing aid algorithm parameters E. In the following $U(y_1)>U(y_2)$ indicates that audio signal $y_1$ is preferred to $y_2$.

An example for the utility function would be the PESQ function (PESQ=Perceptual Evaluation of Speech Quality), which is an International Telecommunication Union (ITU) standard (ITU-T Recommendation P.862) that assigns a speech quality rating (a value between 1 and 5) to a speech signal. This rating is supposed to correspond to how humans rate the quality of speech signals. The parameters in the PESQ function have been selected so that the output of the PESQ function matches the average human responses as closely as possible. According to the present invention, the parameters of the PESQ function are allowed to vary, and the uncertainties relating to values of the utility parameters $\omega$ is expressed by a probability distribution function (PDF) $P(\omega|\alpha)$. Over time, information about the parameters $\omega$ of the utility function is gained through experiments (D) and hereby information is also gained about the (personal) utility function $U(y;\omega)$. Other utility functions may be PAQM, PSQM, NMR, PERCEVAL, DIX, OASE, POM, PEAQ, etc. Another alternative is the speech intelligibility metric disclosed in: "Coherence and the speech intelligibility index", by James M. Kates et. al. in J. Acoust. Soc. Am. 117 (4), 1 Apr. 2005.

Clearly, the utility function $U(y,\omega)$ is different for each user (and may even change over time for a single user). All measurable user data relevant to a utility function are collected in a parameter vector $\alpha\in A$. The vector $\alpha$, in the following denoted the auditory profile, portrait or signature, includes data such as the audiogram, SNR-loss, dynamic range, lifestyle parameters and possibly measurements about a user's cochlear, binaural or central hearing deficit. The audiogram is a recording of the absolute hearing threshold as a function of frequency. SNR loss is the increased dB signal-to-noise ratio required by a hearing-impaired person to understand speech in background noise, as compared to someone with normal hearing. Preferences for utility models of users with auditory profile $\alpha$ are represented a priori by the probability distribution $P(\omega|\alpha)$. Below, user observations (decisions) D are used to update the knowledge about $\omega$ to $P(\omega|D,\alpha)$, and in general, when conditions are not specified, $P(\omega)$.

In the field of hearing aids, it is relevant to determine a user's satisfaction value for all possible input signals from 'the acoustic world', symbolically denoted $\chi$, the space of all possible acoustic signals. P(x) is the probability that signal x occurs in the world $\chi$. Then, the expected utility is $$EU(\theta,\omega)\equiv\varepsilon_x[U]=\int_{x\in\chi}U(x;\theta,\omega)P(x)\,dx \tag{1}$$

using the following notation for expectation:

$$\varepsilon_x[f(x)]\equiv\int_x f(x)\,P(x)dx.$$

It is desirable to maximize expected user satisfaction, and thus the optimal algorithm parameter values $\theta^*$ are obtained by eliminating $\omega$ by integration and maximizing equation (1) with respect to $\theta$. The task of maximizing equation (1) would be difficult even if the user's utility function was exactly known, but unfortunately this is not the case. Typically, users with the same portrait vector $\alpha$ judge sound quality differently and even the same user will provide inconsistent preference feedback over time. In order to retrieve the optimal $\theta^*$, the uncertainty on the utility function must be eliminated by integration (in addition to eliminating the uncertainty on the input signal by integration), which leads to the so-called expected expected utility:

$$EEU(\theta)\equiv\int_x\int_\omega U(x;\theta,\omega)P(\omega)P(x)\,d\omega\,dx \tag{2}$$

The optimal algorithm parameters are then obtained by maximizing the expected expected user utility $$\theta^*=\arg\max_{\theta\in\Theta}EEU(\theta) \tag{3}$$

Equation (3) represents a mathematical formulation of the optimal fitting process.

The optimal algorithm parameters $\theta^*$ maximize the expected expected user satisfaction function EEU where the expectation relates to the uncertainty on the input signal and the parameters of the user's utility function, as expressed by P(x) and $P(\omega)$, respectively.

The hearing aid algorithm design process may now be formulated in mathematical terms. In the first stage, DSP engineers design a library of algorithms $F(\Theta)$, where $\Theta$ is a parameter space. In the second stage, audiologists and dispensers determine the optimal parameter settings $\theta^*\in\Theta$ by computing an approximation to Equation (3). In essence, the method described herein provides the mathematical tools for approximating Equation (3) by far more efficient and accurate methods than is currently available. As mentioned above the optimal values for the algorithm parameters are directly related to the uncertainty on the user satisfaction function U, due to integration of $P(\omega)$ in equation (2). Therefore, in order to get a more accurate estimate for the optimal weight vector $\theta^*$, it is important to reduce the uncertainty on U. This may be done by determining the utility function incrementally based on user observations.

Assume that the $k^{th}$ user observation in a listening test is represented by an observation (or decision) variable $d^k$ and all previous observations are collected in the set $D^{k-1}=\{d^1, d^2, \ldots, d^{k-1}\}$. The knowledge about $\omega$ after k−1 observations is represented by $P(\omega|D^{k-1},\alpha)$.

Preferably, a two by two comparison evaluation protocol is used to elicit user observations through listening tests. Observations can be solicited with respect to any interesting criterion, such as clarity, distortion, comfort, audibility or intelligibility. It has been shown that comparison two by two is an appealing and accurate way to elicit user observations [Neumann et al., 1987]. The $k^{th}$ round of the listening experiment begins with the selection of an (experiment) tuple $e^k=\{x^k, \theta_1^k, \theta_2^k\}$, where $\theta_1^k$ and $\theta_2^k$ are two admissible parameter vector values. (In the next section it is shown that it is possible to select an experiment tuple that will provide the largest expected information gain from the user's observation $d^k$). A user gets the opportunity to listen to the two processed signals $y_1^k(t)=F(x^k(t);\theta_1^k)$ and $y_2^k(t)=F(x^k(t);\theta_2^k)$ and record the preferred signal in a decision variable $d^k$. Upon recording the user observation $d^k$, the knowledge about $\omega$ may be updated using Bayes rule through $$\begin{aligned} P(\omega \mid D^k, \alpha) &= P(\omega \mid d^k, e^k, D^{k-1}, \alpha) \\ &= \frac{P(d^k \mid \omega, e^k, D^{k-1}, \alpha)P(\omega \mid e^k, D^{k-1}, \alpha)}{P(d^k \mid e^k, D^{k-1}, \alpha)} \\ &\propto P(d^k \mid e^k, \omega)P(\omega \mid D^{k-1}, \alpha) \end{aligned} \tag{4}$$

since the denominator $P(d^k|e^k, D^{k-1}, \alpha)$ is not a function of $\omega$ and $P(d^k|\omega, e^k, D^{k-1}, \alpha)=P(d^k|e^k,\omega)$ for independent observations $d^k$. Equation (4) shows that only the likelihood $P(d^k|e^k,\omega)$ is needed to update from prior distribution $P(\omega|D^{k-1},\alpha)$ to present distribution $P(\omega|D^k,\alpha)$. An expression for the likelihood $P(d^k|e^k,\omega)$ is derived below.

Assign $d^k=1$ if the user prefers $y_1^k$ to $y_2^k$ and similarly, $d^k=-1$ indicates that the user prefers $y_2^k$. Then $$d^k = \begin{matrix} +1 \\ -1 \end{matrix} \Leftrightarrow U(x^k; \theta_1^k, \omega) - (U(x^k; \theta_2^k, \omega) \begin{matrix} \rangle \\ \langle \end{matrix} 0 \tag{5}$$

Equation (5) relates a user's actual decision $d^k$ to the (parameterized) model for user decisions $U(x;\theta,\omega)$. A logistic regression (a.k.a. Bradley-Terry) model is used to predict a user's decision, $$P(d^k \mid e^k, \omega) = \frac{1}{1 + \exp\{-d^k \times [U(x^k; \theta_1^k, \omega) - U(x^k; \theta_2^k, \omega)]\}} \tag{6}$$

After the $k^{th}$ user observation, the actual observation value $d^k$ is used to compute $P(d^k|e^k,\omega)$ through equation (6). Then, substitution into equation (4) leads to an update of information about $\omega$ from $P(\omega|D^{k-1},\alpha)$ to $P(\omega|D^k,\alpha)$. After multiple observations, the decreased uncertainty on $\omega$ leads to a better estimate of the expected expected utility $EEU(\theta)$ and hence, on account of the fitting equation (3) to a more accurate estimate of optimal hearing aid algorithm parameters $\theta^*$.

Thus, it is possible to improve the estimate of the optimal algorithm parameter vector $\theta^*$ in a consistent way after every single user observation $d^k$.

In the previous section, the user satisfaction function $U(y;\omega)$ was updated based on a single two by two comparative listening event. In a clinical session, the 'experiment leader' (who is typically an audiologist or hearing aid dispenser) selects a design tuple: $e^k=\{x^k,\theta_1^k, \theta_2^k\}$ for the $k^{th}$ listening event. It is desirable to reach the optimal algorithm settings based on a minimum number of listening observations. Such a strategy could significantly reduce the burden on the user (and the experiment leader).

According to the present invention, a method is provided of selecting the design tuple that leads to a maximum increase in expected expected utility $EEU(\theta)$. The Bayesian approach makes it possible to make such desirable selections.

After k−1 listening events, the expected expected utility is given by $$EEU^{k-1}(\theta) = \int_x \int_\omega U(x; \theta, \omega)P(\omega \mid D^{k-1}, \alpha)P(x)\,d\omega\,dx \tag{7}$$

After the $k^{th}$ observation ($d^k$), $P(\omega|D^k,\alpha)$ substitutes $P(\omega|D^{k-1},\alpha)$ in equation (7). While the $k^{th}$ observation is not known yet at the time that the $k^{th}$ design tuple is selected, a statistic estimate for the $k^{th}$ observation may be calculated from $$P(d^k|e^k,D^{k-1})=\int P(d^k|e^k,\omega)P(\omega|D^{k-1})d\omega \tag{8}$$

where only information from before the $k^{th}$ event is used. The expected expected user satisfaction after the $k^{th}$ observation, given only information from before the $k^{th}$ event, is then $$EEU^{k|(k-1)}(\theta) \equiv \sum_{j=\{-1,1\}} P(d^k = j \mid e^k, D^{k-1}) \square \varepsilon_x\{\varepsilon_{w|\{D^{k-1},d^k=j\}}[U]\} \tag{9}$$

The expected increase in (maximal expected expected) user satisfaction if $d^k$ were to be observed is $$VPI^k(e) \equiv \max_\theta\{EEU^{k|(k-1)}\} - \max_\theta\{EEU^{k-1}\} \tag{10}$$

In Decision Theory, equation (10) is called the "Value of Perfect Information" (VPI), since it reflects the increase in maximum EEU (i.e. the 'value') if a new piece of information ($d^k$) would become perfectly known. From all possible listening experiments $e^k \in (X \times \Theta \times \Theta)$, the one that maximizes the VPI is selected, i.e.

$$e^k = \underset{e}{\operatorname{argmax}}\, VPI^k(e) \tag{11}$$

The VPI criterion determines the listening experiment to be performed at any time, and also when to stop the experiment. When $VPI(e^k)$ becomes less than the cost of performing the $k^{th}$ listening test, the experiment should stop. Generally, the cost of a listening test increases as time progresses due to listener fatigue and time constraints. Obviously, the option to suggest to the experiment leader which listening event to perform and when to stop is an appealing feature for a commercial (or non-commercial) fitting software system.

Above, a principal method is disclosed where each perceptual observation of each user contributes to the further refinement of a statistic user satisfaction model. According to this statistic approach, it does not matter that different users have different judgments, since the 'spread of opinions' is part of the utility model.

According to the present invention, a method is provided that makes it possible to effectively learn a complex relationship between desired adjustments of signal processing parameters and corrective user adjustments that are a personal, time-varying, nonlinear, stochastic (noisy) function of a multi-dimensional environmental classification signal.

The method may for example be employed in automatic control of the volume setting as further described below, maximal noise reduction attenuation, settings relating to the sound environment, etc.

Fitting is the final stage of parameter estimation, usually carried out in a hearing clinic or dispenser's office, where the hearing aid parameters are adjusted to match one specific user. Typically, according to the prior art the audiologist measures the user profile (e.g. audiogram), performs a few listening tests with the user and adjusts some of the tuning parameters (e.g. compression ratio's) accordingly. However, according to the present invention, the hearing aid is subsequently subjected to an incremental adjustment of signal processor parameters during its normal use that lowers the requirement for manual adjustments. For example, the utility model provides the 'knowledge base' for an optimized incremental adjustment of signal processor parameters.

The audiologist has available a library of hearing aid algorithms $F(x,\Theta)$, where $\Theta$ is the algorithm parameter space and x is a sample from an audio database $\chi$ for performing listening tests. Furthermore, the dispenser has available a user satisfaction model $U(y;\omega)$, where the uncertainty about the model parameters is given by a PDF $P(\omega|\alpha)$ that relates auditory profiles $\alpha$ to utility model parameters $\omega$. The fitting goal is to select an optimal value $\theta^*\in\Theta$ for any specific user.

The hearing aid dispenser may select to use a standard auditory profile $\alpha$ for every hearing aid user leading to common starting values of the uncertainties $P(\omega)$ of the parameters $\omega$ of the utility function $U(y;\omega)$ for all users. Then, according to the invention, the utilisation of Bayesian incremental preference elicitation incrementally improves the approximation to the actual user's utility function upon a user decision $d^k$. Thus, in an embodiment of the invention, the method comprises the steps of recording the user's $k^{th}$ decision $d^k$ in response to a signal $x^k$, and update $P(\omega)$ in accordance with $$P(\omega|D^k)\propto P(d^k|x^k,\omega)P(D^{k-1}),\text{ and}$$

calculating a new optimum $\theta_k^*$ for the algorithm parameters in accordance with $$\theta_k^* = \underset{\theta}{\operatorname{argmax}}\sum_n \int_\omega U(x_n,\theta,\omega)P(\omega\mid D^k)\,d\omega.$$

It is an important advantage of this embodiment, that no fitting session is required to adjust signal processing parameters of the hearing aid. In stead, every user receives electronically identical hearing aids, and the required adjustments are performed over time during daily use of each hearing aid.

The dispenser may select to use an auditory profile $\alpha$ including some knowledge about the user, such as age, sex, type of hearing loss, etc, that is common for a group of hearing aid users. Thus, in an embodiment of the invention, the method comprises the steps of recording the user's $k^{th}$ decision $d^k$ in response to a signal $x^k$, and update $P(\omega)$ in accordance with recording the user's $k^{th}$ decision $d^k$ in response to a signal $x^k$, and update $P(\omega)$ in accordance with $$P(\omega|D^k,\alpha)\propto P(d^k|\omega)P(\omega|D^{k-1},\alpha),\text{ and}$$

calculating a new optimum $\theta_k^*$ for the algorithm parameters in accordance with $$\theta_k^* = \underset{\theta}{\operatorname{argmax}}\sum_n P(x_n)\int_\omega U(x_n,\theta,\omega)P(\omega\mid D^k,\alpha)\,d\omega.$$

This requires an initial adjustment of the hearing aid before it is supplied to the user, but may lead to a more rapid adjustment of hearing aid parameters to each user's requirements still without the need of performing audiological measurements on individual users.

In yet another embodiment of the invention, after a user has entered the office, the dispenser measures relevant user information (such as the audiogram and/or a speech-in-noise test) and records these measurements as $\alpha=\alpha_0$. Prior to any listening tests, the PDF over utility model parameters is now given by $P(\omega|\alpha=\alpha_0)$.

Based on the utility model, the (on the average) best perceived algorithm parameters by users with similar auditory profile is calculated:

$$\theta_0^* = \underset{\theta}{\operatorname{argmax}}\sum_n P(x_n)\int_\omega U(x_n;\theta,\omega)P(\omega\mid\alpha_0)\,d\omega. \tag{12}$$

Since every user with the same auditory profile does not perceive hearing aid algorithms in the same way, the session may proceed by a sequence of optimally chosen listening events that fine-tune the algorithm settings for the specific user (until user satisfaction). The $k^{th}$ iteration in this process proceeds according to steps (a), (b), and (c) below:

(a) Optimal experiment selection. A listening experiment is selected that maximizes the Value of Perfect Information, as mentioned above $$e^k = \underset{e}{\arg\max}\, VPI^k(e) \tag{13}$$

(b) Perform listening test. Present $e^k$ to the user, record his preference $d^k$ and update the PDF over the utility parameters $$P(\omega|D^k,\alpha_0)\propto P(d^k|e^k,\omega)P(\omega|D^{k-1},\alpha_0) \tag{14}$$

(c) Iterate fit. The knowledge about the user's personalized utility function is now updated and a new optimum for the algorithm parameters may be found by $$\theta_k^* = \underset{\theta}{\operatorname{argmax}}\sum_n P(x_n)\int_\omega U(x_n;\theta,\omega)P(\omega\mid D^k,\alpha_0)\,d\omega \tag{15}$$

In contrast to current fitting practices, this procedure computes the best values for algorithm parameters (rather than just, for instance, compression ratios), and does so after a minimal number of listening events (that is: in minimal time).

It even works if the audiologist decides to perform no listening tests: a good initial fit (in this case averaged over all users with similar profile $\alpha_0$) may still be obtained and if time permits further personalization may be performed in minimal time to provide a more accurate algorithm fit. Moreover, every listening test performed during the fitting session will add to improve the utility model (and hence Knowledge Building is an important added benefit of the fitting procedure according to the present invention). Note that the difference between optimal parameter values $\theta_0$* and $\theta_k$* is entirely determined by the knowledge (uncertainty) about the user's satisfaction model parameters ($P(\omega|\alpha_0)$ vs. $P(\omega|D^k,\alpha_0)$ respectively).

Since the method according to the invention for hearing aid fitting is completely automated, a web-based hearing aid fitting system may be provided that the user can run from his own home (or in a clinic), based on the Bayesian Incremental Fitting procedure.

After a user has left the dispenser's office, the user may fine-tune the hearing aid containing a model that learns from user feedback and having a suitable user-interface, such as a control wheel, such as the well-known volume-control wheel, a push-button, a remote control unit, the world wide web, tapping on the hearing aid housing (e.g. in a particular manner), etc.

The personalization process continues during normal use. The user-interface, such as the conventional volume control wheel, may be linked to a new adaptive parameter that is a projection of a relevant parameter space. For example, this new parameter, in the following denoted the personalization parameter, could control (1) simple volume, (2) the number of active microphones or (3) a complex trade-off between noise reduction and signal distortion. By turning the control wheel (i.e. 'personalization wheel') to preferred settings and absorbing these preferences in the model, e.g. the personal utility model, resident in the hearing aid, it is possible to keep learning and fine-tuning while a user wears the hearing aid device in the field.

An algorithm for in-the-field personalization may be a special case of the Bayesian incremental fitting algorithm, without the possibility of selecting optimal listening experiments.

The output of an environment classifier may be included in the user adjustments for provision of a method according to the present invention that is capable of distinguishing different user preferences caused by different sound environments. Hereby signal processing parameters may automatically be adjusted in accordance with the user's perception of the best possible parameter setting for the actual sound environment.

The input signal probability function $P(x_n)$ may have the same value for all input signals $x_n$.

The updating of the probability density function $P(\omega)$ according to the present invention may be performed each time a user makes a decision. Alternatively, the updating of the probability density function $P(\omega)$ may be performed in accordance with certain criteria, for example that the user has made a predetermined number of decisions so that only significant decisions lead to an update of the probability density function $P(\omega)$.

In another embodiment, the updating is performed upon a predetermined number of user decisions performed within a predetermined time interval.

According to an embodiment of the invention, a method of automatic adjustment of a set $\underline{z}$ of the signal processing parameters $\underline{\Theta}$ is provided, in which a set of learning parameters $\underline{\theta}$ of the signal processing parameters $\underline{\Theta}$ is utilized, the method comprising the steps of:

extracting signal features $\underline{u}$ of a signal in the hearing aid, recording a measure $\underline{r}$ of an adjustment $\underline{e}$ made by the user of the hearing aid, modifying $\underline{z}$ by the equation:

$$\underline{z}=U\underline{\theta}+\underline{r}$$

and absorbing the user adjustment $\underline{e}$ in $\underline{\theta}$ by the equation:

$$\underline{\theta}_N=\Phi(\underline{u},\underline{r})+\underline{\theta}_P$$

wherein $\underline{\theta}_N$ is the new values of the learning parameter set $\underline{\theta}$, $\underline{\theta}_P$ is the previous values of the learning parameter set $\underline{\theta}$, and $\Phi$ is a function of the signal feature vector $\underline{u}$ and the recorded adjustment measure $\underline{r}$.

$\Phi$ may form a normalized Least Means Squares algorithm, a recursive Least Means Squares algorithm, a Kalman algorithm, a Kalman smoothing algorithm, IDBD, K1, K2, or any other algorithm suitable for absorbing user preferences.

In one or more embodiments, z may be a one-dimensional variable g, and $g=\underline{f}^T\underline{\phi}+w$, where f is a vector that contains $\underline{u}$, $\underline{\phi}$ is a vector that contains $\underline{\theta}$, and w is a noise value with variance VUS, and wherein the parameter set $\underline{\phi}$ is non-stationary and follows the model $\underline{\phi}_N=G\,\underline{\phi}_P+\underline{v}$, where G is a matrix, v is a noise vector with variance VPHI, and $\underline{\theta}$ is learned with an algorithm based on Kalman filtering.

In a preferred embodiment of the invention, the user adjustment $\underline{e}$ is absorbed in $\underline{\theta}$ by the equation:

$$\underline{\theta}_N=\frac{\mu}{\sigma^2+\underline{u}^T\underline{u}}\underline{u}^T\underline{r}+\underline{\theta}_P$$

wherein $\mu$ is the step size, and subsequently a new recorded measure $\underline{r}_N$ of the user adjustment $\underline{e}$ is calculated by the equation:

$$r_N=r_P-\underline{u}^T\underline{\theta}_P+\underline{e}$$

wherein $\underline{r}_P$ is the previous recorded measure. Further, a new value $\sigma_N$ of the user inconsistency estimator $\sigma^2$ is calculated by the equation:

$$\sigma_N^2=\sigma_P^2+\gamma[r_N^2-\sigma_P^2]$$

wherein $\sigma_P$ is the previous value of the user inconsistency estimator, and $\gamma$ is a constant.

$\underline{z}$ may be a one-dimensional variable g and $\underline{r}$ may be a one-dimensional variable r, so that $$g=\underline{u}^T\underline{\theta}+r.$$

As already mentioned, methods according to the present invention have the capability of absorbing user preferences changing over time and/or changes in typical sound environments experienced by the user. The personalization of the hearing aid may be performed during normal use of the hearing aid. These advantages are obtained by absorbing user adjustments of the hearing aid in the parameters of the hearing aid processing. Over time, this approach leads to fewer user manipulations during periods of unchanging user preferences. Further, the methods are robust to inconsistent user behaviour.

Preferably, user preferences for algorithm parameters are elicited during normal use in a way that is consistent and coherent and in accordance with theory for reasoning under uncertainty.

A hearing aid with a signal processor that is adapted for operation in accordance with a method according to the present invention is capable of learning a complex relationship between desired adjustments of signal processing parameters and corrective user adjustments that are a personal, time-varying, nonlinear, and/or stochastic.

The method may for example be employed in automatic control of the volume setting, maximal noise reduction, settings relating to the sound environment, etc.

As already mentioned, the output of an environment classifier may be included in the user adjustments for provision of a method according to the present invention that is capable of distinguishing different user preferences caused by different sound environments. Hereby, signal processing parameters may automatically be adjusted in accordance with the user's perception of the best possible parameter setting for the actual sound environment.

In one exemplary embodiment, the method is utilized to adjust parameters of a noise reduction algorithm. A noise reduction algorithm PNR is influenced by a noise reduction aggressiveness' parameter called 'PNR depth', denoted by d. The d can be the same or different for the several frequency bands and is fixed beforehand. For different frequency bands with different d, a PNR depth vector is defined by $\underline{D}$=[d1, d2, . . . , dN], where N is the number of frequency bands. It is proposed to learn the PNR depth parameters that are optimal for a certain user. Higher PNR depth means more noise suppression, but possibly also more distortion of the sounds. The optimal trade-off is user and environment dependent.

The gain depth vector $\underline{D}$ is parameterized as a weighted sum of certain features of the sound signal and an additional user correction: $\underline{D}=U\underline{\theta}+\underline{r}$.

The same algorithms for LVC may now be used to learning the preferred PNR depth vector $\underline{D}$, i.e. finding the weight vector theta that is optimal for a certain user.

As an example, a user may now turn the volume wheel or e.g. a slider on a remote control in order to influence the trade-off between noise reduction and sound distortion. In situations with speech and stationary noise this may lead to different preferred trade-offs than e.g. in situations with non-stationary noises like traffic that are corrupting the speech. The user feeds back preferences to the hearing aid during usage and the learning algorithm LNR adapts the mapping from environmental features to PNR depth settings. The aim is that the user comfort becomes progressively higher as the hearing aid performs a more and more personalized noise reduction.

Figure 2:
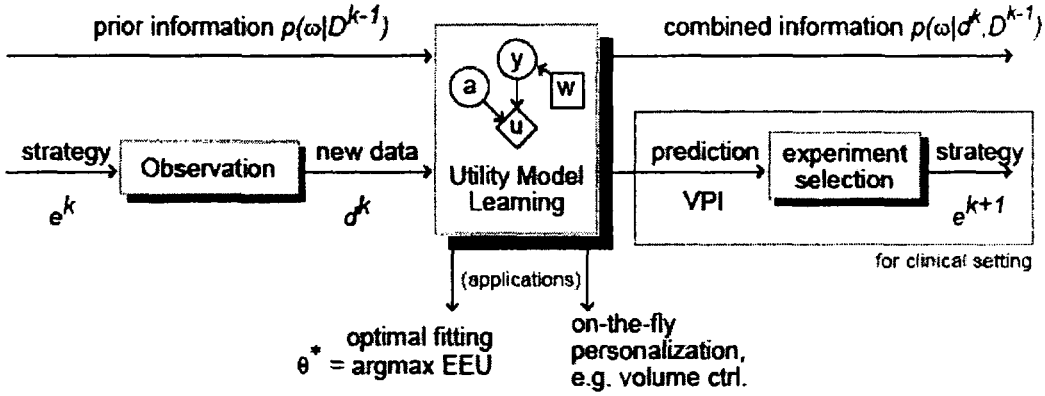
Figure 5:
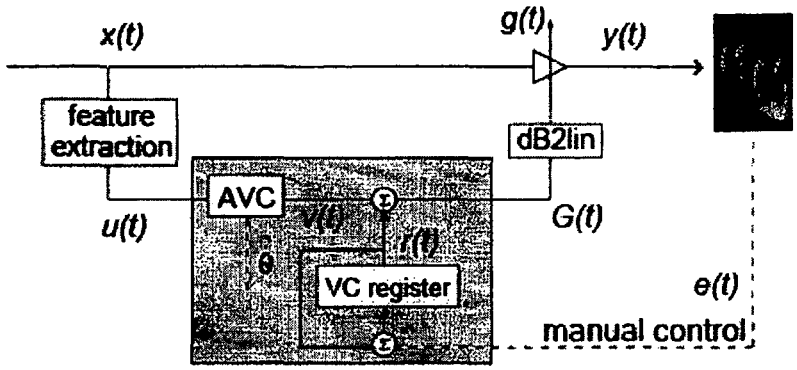
Figure 6:
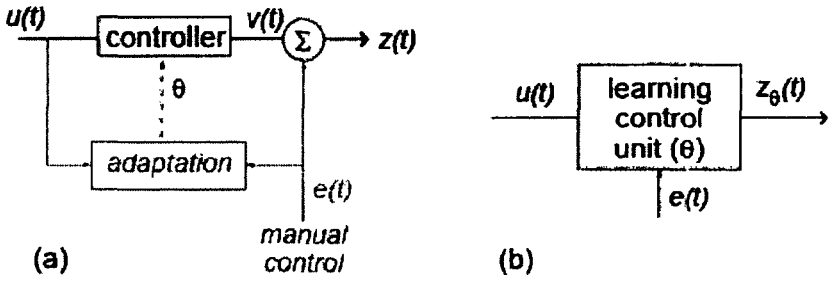
Figure 7:
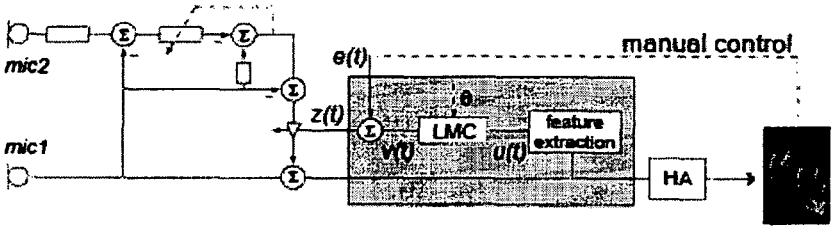
Figure 8:
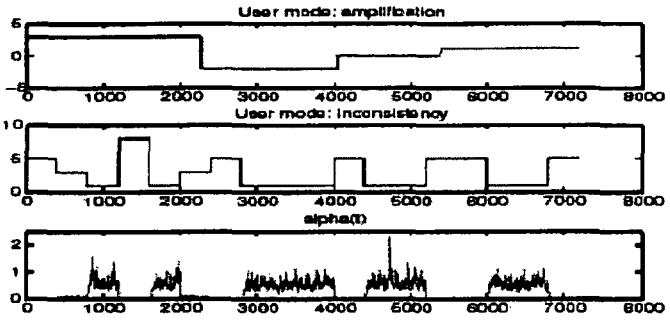
Figure 9:
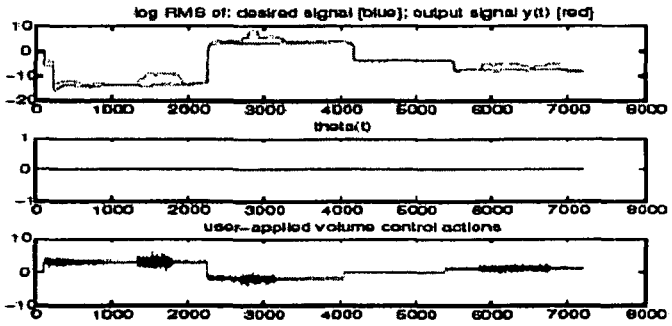
Figure 10:
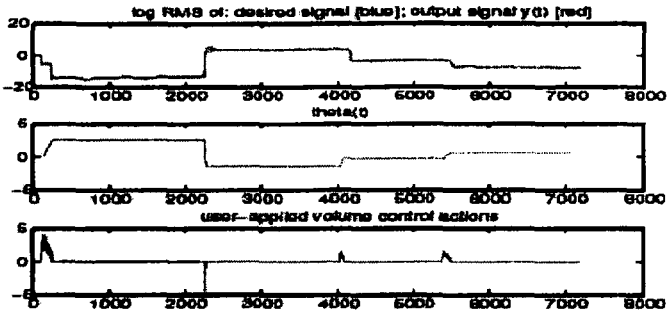
Figure 11:
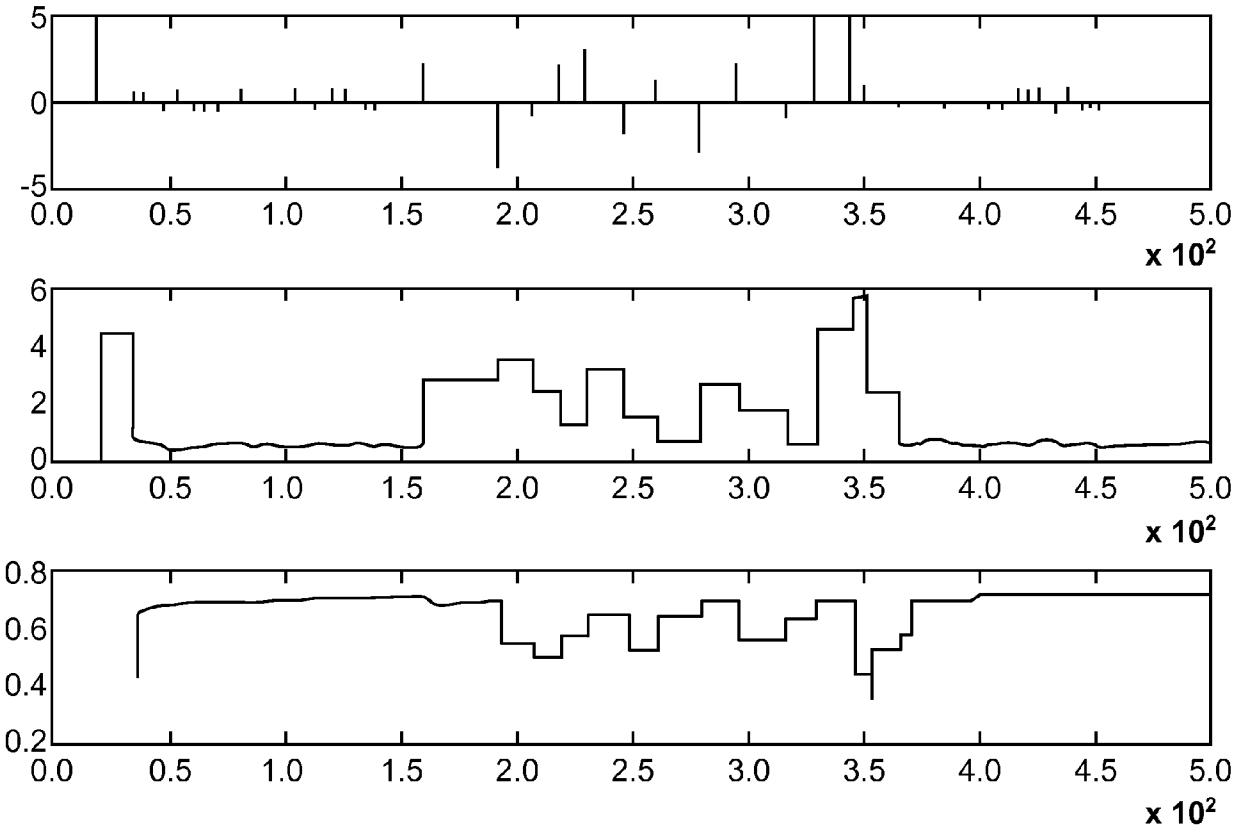
Figure 12:
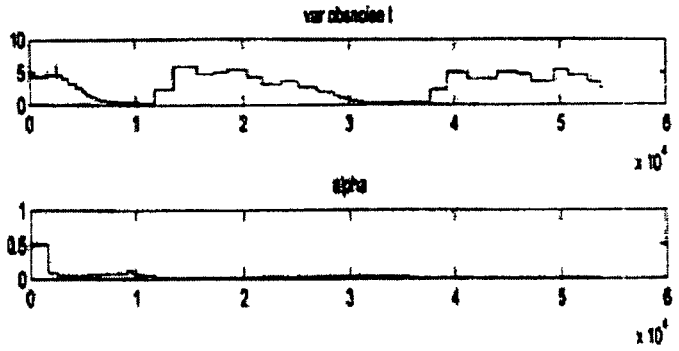
Figure 13:
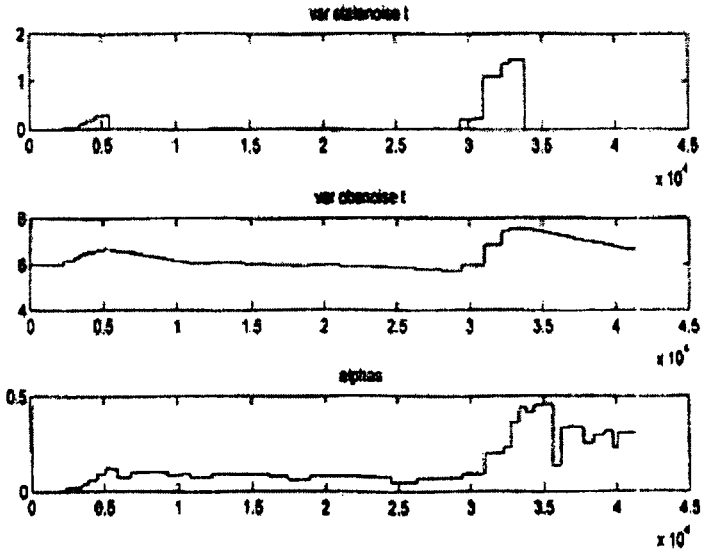
Figure 14:
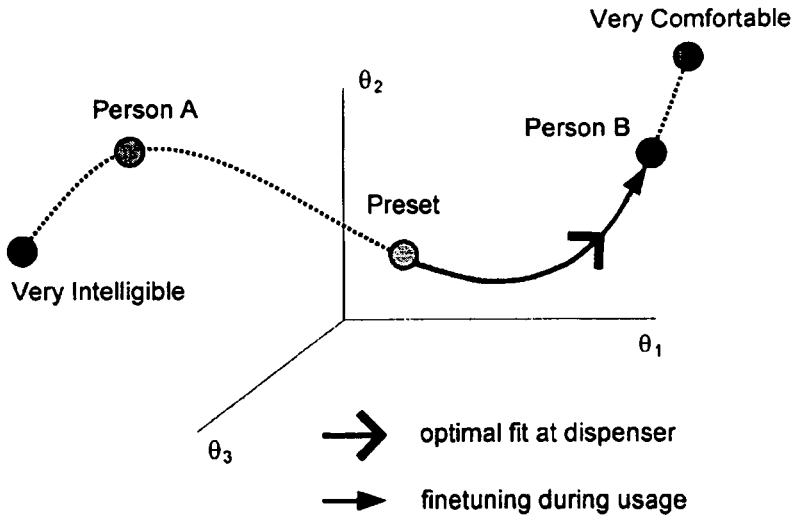
Figure 15:
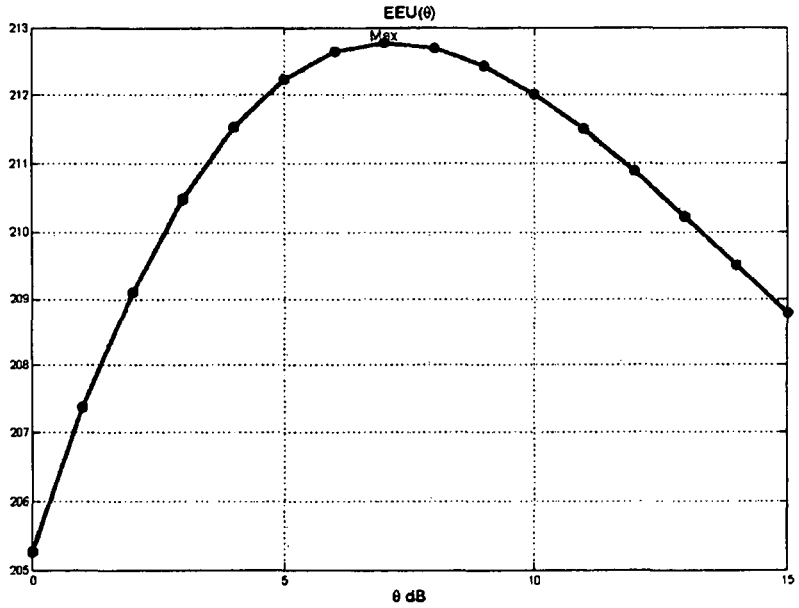
Figure 16:
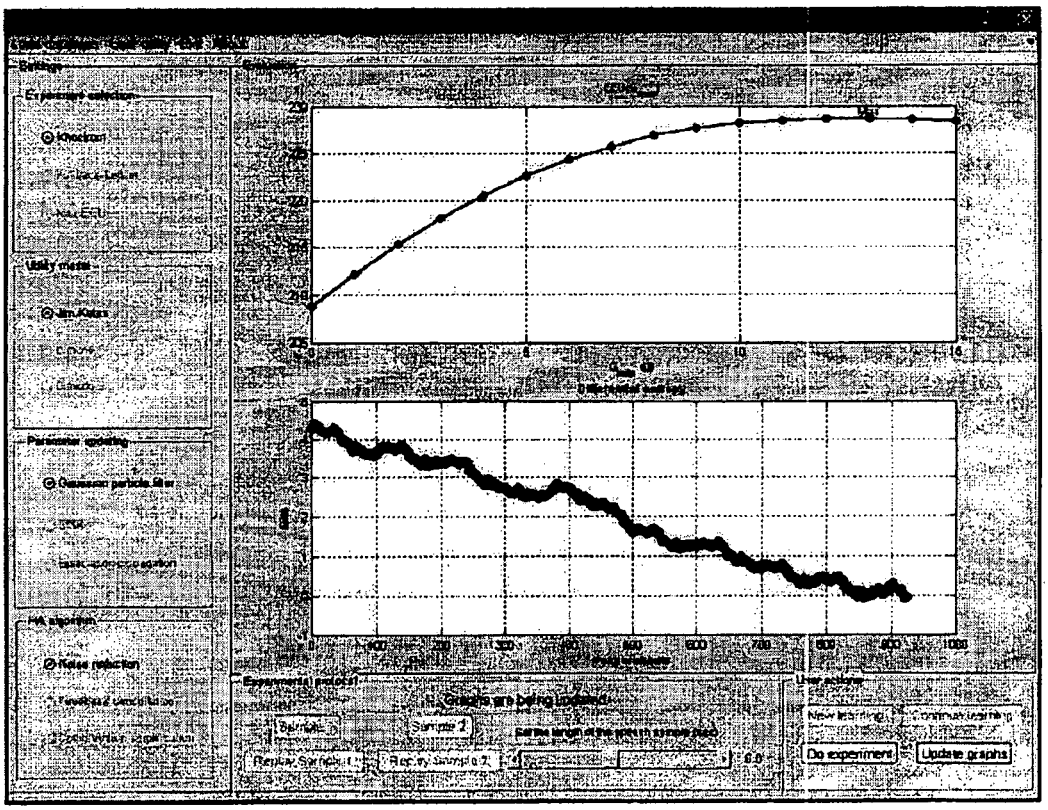

The above and other features and advantages of the present invention will become more apparent to those of ordinary skill in the art by describing in detail exemplary embodiments thereof with reference to the attached drawings in which:

FIG. 1 shows a simplified block diagram of a digital hearing aid according to the present invention, FIG. 2 is a block diagram illustrating utility function learning according to the present invention, FIG. 3 shows the steps of a Bayesian incremental fitting algorithm according to the present invention, FIG. 4 shows the steps of a Bayesian incremental personalization algorithm according to the present invention, FIG. 5 schematically illustrates the operation of a learning volume control algorithm according to the present invention, FIG. 6 is a flow diagram of a learning control unit according to the present invention, FIG. 7 is a block diagram of the signal processing in a hearing aid with learning microphone control according to the present invention, and FIG. 8 is a plot of user amplification preference, user inconsistency, and inferred learning rate, FIG. 9 is a plot of output signal $y_t$ and desire output signal without learning, FIG. 10 is a plot similar to the plot of FIG. 9, but with learning, FIG. 11 is a plot illustrating nLMS learning volume control, FIG. 12 is a plot illustrating Kalman filter learning volume control, FIG. 13 is a plot illustrating a simplified Kalman filter learning volume control, FIG. 14 is a 3D plot illustrating parameter adjustment in a learning tinnitus masker, FIG. 15 is a plot of the expected expected utility EEU for learning noise reduction, and FIG. 16 is a screen dump of plots of expected expected utility and differential entropy of weights H(ω).

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art.

FIG. 1 shows a simplified block diagram of a digital hearing aid according to the present invention. The hearing aid 1 comprises one or more sound receivers 2, e.g. two microphones 2*a* and a telecoil 2*b*. The analogue signals for the microphones are coupled to an analogue-digital converter circuit 3, which contains an analogue-digital converter 4 for each of the microphones.

The digital signal outputs from the analogue-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The DSP is further programmed for automatic adjustment of signal processing parameters in accordance with the method of the present invention.

The output signal is then fed to a digital-analogue converter 12, from which analogue output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus 17, can be provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

FIG. 2 shows a blocked diagram illustrating the method according to the present invention based on Bayesian incremental preference elicitation.

The Bayesian Incremental Fitting (BI-FIT) Algorithm is summarized in FIG. 3.

The Bayesian Incremental Personalization (BI-PER) algorithm is summarized in FIG. 4.

FIG. 5 schematically illustrates the operation of a learning volume control algorithm according to the present invention. The illustrated hearing aid circuit includes an automatic volume control circuit that operates to adjust the amplitude of a signal x(t) by a gain g(t) to output y(t)=g(t) x(t). An automatic volume control (AVC) module controls the gain $g_t$. The AVC unit takes as input $u_t$, which holds a vector of relevant features with respect to the desired gain for signal $x_t$. For instance, $u_t$ could hold short-term RMS and SNR estimates of $x_t$. In a linear AVC, the desired (log-domain) gain $G_t$ is a linear function (with saturation) of the input features, i.e.

$$G_t=u_t^T\theta_t+r_t \tag{16}$$

where the offset $r_t$ is read from a volume-control (VC) register. $r_t$ is a measure of the user adjustment. Sometimes, during operation of the device, the user is not satisfied with the volume of the received signal $y_t$. The user is provided with the opportunity to manipulate the gain of the received signal by changing the contents of the VC register through turning a volume control wheel. $e_t$ represents the accumulated change in the VC register from t−1 to t as a result of user manipulation. The learning goal is to slowly absorb the regular patterns in the VC register into the AVC model parameters θ. Ultimately, the process will lead to a reduced number of user manipulations. An additive learning process is utilized, $$\theta_{t+1} = \theta_t + \overset{0}{\theta}_t \tag{17}$$

where the amount of parameter drift $\overset{0}{\theta}_t$ is determined by the selected learning algorithms, such as LMS or Kalman filtering.

A parameter update is performed only when knowledge about the user's preferences is available. While the VC wheel is not being manipulated during normal operation of the device, the user may be content with the delivered volume, but this is uncertain. After all, the user may not be wearing the device. However, when the user starts turning the VC wheel, it is assumed that the user is not content at that moment. The beginning of a VC manipulation phase is denoted the dissent moment. While the user manipulates the VC wheel, the user is likely still searching for a better gain. A next learning moment occurs right after the user has stopped changing the VC wheel position. At this time, it is assumed that the user has found a satisfying gain; and this is called the consent moment. Dissent and consent moments identify situations for collecting negative and positive teaching data, respectively. Assume that the kth consent moment is detected at $t=t_k$. Since the updates only take place at times $t_k$, it is useful to define a new time series as $$G_k = \sum_t G_t\delta(t-t_k)$$

and similar definitions for converting $r_t$ to $r_k$ etc. The new sequence, indexed by k rather than t, only selects samples at consent moments from the original time series. Note that by considering only instances of explicit consent, there is no need for an internal clock in the system. In order to complete the algorithm, the drift $\overset{0}{\theta}_k$ needs to be specified.

Two update algorithms according to the present invention is further described below. Learning by the nLMS algorithm In the nLMS algorithm, the learning update Eq. (17) should not affect the actual gain $G_t$ leading to compensation by subtracting an amount $u_t^T\overset{0}{\theta}_t$, from the VC register. The VC register contents are thus described by $$r_{t+1} = r_t - u_t^T\overset{0}{\theta}_t + e_{t+1} \tag{18}$$

wherein t is a time of consent and t+1 is the next time of consent. It should be noted that $r_t$ has a value for all values of t, but that only at a time of consent, user adjustment $e_t$ and discount $u^T\overset{0}{\theta}_t$, are applied. The correction $e_k$ at a consent time $t_k$ is equal to the accumulated corrections $$\sum_{t_{k-1}+1}^{t_k} e_t.$$

It is assumed that $$\mu_t^T\theta_t=[1,u_t^1,\ldots,u_t^m][\theta_t^0,\theta_t^1,\ldots,\theta_t^m]^T$$

where the superscript m refers to the $m+1^{st}$ component of the vectors $u_t$ and $\theta_t$. In other words, $\theta_t^0$ is provided to absorb the preferred mean VC offset. It is then reasonable to assume a cost criterion $\epsilon[r_k^2]$, to be minimized with respect to θ (and $\epsilon[\bullet]$ denotes expectation). A normalized LMS-based learning volume control is effectively implemented using the following update equation $$\overset{0}{\theta}_k = \mu_k u_k^T r_k = \frac{\mu}{\sigma_k^2 + u_k^T u_k} u_k^T r_k \tag{19}$$

where μ is an initial learning rate, $\mu_k$ is an estimated learning rate, and $\sigma_k^2$ is an estimate of $\epsilon[r_k^2]$. In practice, it is helpful to select a separate learning rate for adaption of the offset parameter $\theta_0$. $\epsilon[r_k^2]$ is tracked by a leaky integrator, $$\sigma_k^2=\sigma_{k-1}^2+\gamma\times[r_k^2-\sigma_{k-1}^2] \tag{20}$$

where γ sets the effective window of the integrator. Note that the LMS-based updating implicitly assumes that 'adjustment errors' are Gaussian distributed. The variable $\sigma_k^2$ essentially tracks the user inconsistency. As a consequence, for enduring large values of $r_k^2$, the parameter drift will be small, which means that the user's preferences are not absorbed. This is a desired feature of the LVC system. It is possible to replace $\sigma_k^2$ in Eq. (19) by alternative measures of user inconsistency. Alternatively, in the next section the Kalman filter is introduced, which is also capable of absorbing inconsistent user responses.

Learning with a Kalman Filter

When a user changes his preferences, the user will probably induce noisy corrections to the volume wheel. In the nLMS algorithm, these increased corrections would contribute to the estimated variance $\sigma_k^2$ hence lead to a decrease in the estimated learning rate.

However, the noise in the correction could also be attributed to a transition to a new 'parameter state'. It is desirable to increase the learning rate with the estimated state noise variance in order to respond quickly to a changed preference pattern.

In the following, the user is an inconsistent user with changing preferences and a preferred gain given by $G_t=u_t^T a_t^d$, $\forall t$. The 'user preference vector' $a_t^d$ may be non-stationary (hence the subscript t) and is supposed to generalise to different auditory scenes. This requires that feature vector $u_t$ contains relevant features that describe the acoustic input well. The user will express his preference for this sound level by adjusting the volume wheel, i.e. by feeding back a correction factor that is ideally noiseless ($e_k^d$) and adding it to the register $r_k$. In reality, the actual user correction $e_k$ will be noisy, $r_{k+1}=r_k-u_k^T\overset{0}{\theta}_k+e_{k+1}=r_k-u_k^T\overset{0}{\theta}_k+e_{k+1}^d+\epsilon_{k+1}$. Here, $\epsilon_{k+1}$ is the accumulated noise from the previous consent moment to the current, and it is supposed to be Gaussian distributed. It is assumed that the user experiences an 'annoyance threshold' $\bar{e}$ such that $|\overline{e_t^d}|\leq\bar{e}\rightarrow e_t=0$. In other words, only if the intended correction exceeds the annoyance threshold, the user will be in explicit dissent and will issue a (noisy) correction.

State Space Formulation

Allowing the parameter vector that is to be estimated to 'drift' with some (state) noise, leads to the following state space formulation of the linear volume control:

$$\theta_{k+1}=\theta_k+v_k, v_k\sim N(0,\delta^2 I)$$

$$G_k=u_k^T\theta_k+r_k, r_k\sim\text{nongaussian}$$

Besides the gain model (cf. Eq. (16)), a model for the parameter drift is now provided. The posterior of $\theta_k$ can be estimated recursively using the corresponding Kalman filter update equations. The resulting LVC algorithm is referred to as simplified Kalman filter LVC. It is instructive to compare the estimated learning rates in the nLMS algorithm and the simplified Kalman filter. Both give rise (cf. W. D. Penny, "Signal processing course", Tech. Rep., University College London, 2000, 2) to an effective update rule $$\hat{\theta}_{k+1}=\hat{\theta}_k+\overset{0}{\theta}_k=\hat{\theta}_k+\mu_k\mu_k^T r_k \tag{21}$$

for the mean $\hat{\theta}_k$ of the parameter vector (and additionally, the Kalman filter also updates its variance $\Sigma_k$). The difference between the algorithms is in the $\mu_k$ term, which in the Kalman LVC is $$\mu_k=\Sigma_{k|k-1}(u_k\Sigma_{k|k-1}u_k^T+\sigma_k^2)^{-1} \tag{22}$$

where $\mu_k$ is now a learning rate matrix. For the Kalman algorithm, the learning rate is dependent on the state noise $v_k$, through the predicted covariance of state variable $\theta_k$, $\Sigma_{k|k-1}=\Sigma_{k-1}+\delta^2 I$. The state noise can become high when a transition to a new dynamic regime is experienced. Furthermore, it scales inversely with observation noise $\sigma_k^2$, i.e. the uncertainty in the user response. The more consistent the user operates the volume control, the smaller the estimated observation noise, the larger the learning rate. The nLMS learning rate only scales (inversely) with the user uncertainty. Online estimates of the noise variances $\delta^2$, $\sigma^2$ can be made with the Jazwinski method (again cf. W. D. Penny, "Signal processing course", Tech. Rep., University College London, 2000, 2). Further, note that the observation noise is non-Gaussian in both nLMS and the state space formulation of the LVC. Especially the latter, which is solved with a recursive (Kalman filter) algorithm is sensitive to model mismatch. This can be solved by making an explicit distinction between the 'structural part' $e_k^d$ in the correction and the actual noisy adjustment $e_k=e_k^d+\epsilon_k$ (see next section).

In the following, the approach is taken that a user correction can be fully absorbed by the AVC in one update instant, provided that it represents the underlying desired correction (and not the noisy version that is actually issued). The desired correction factor is modelled by $e_k^d=u_k^T\lambda_k$ and incorporate this in $\theta_k$ in one update instant. The idea behind this model is that the user deduces from the temporal structure in the past values $v_{t-M} \ldots v_t$ the mismatch between the user's desired overall gain vector $a^d$ and the currently realised gain vector $\theta_t$, even though the user does not know (although the user will perceive some aspects of the sound features) the instantaneous value of the $u_t$ (but only experiences the current $v_t=u^T\theta_t$, see FIG. 5). In this case, his desired correction at the next update would then be the result of an implicit comparison of $a^d$ with $\theta_t$, or $e_{k+1}^d=u_{k+1}^T\lambda_{k+1}=u_{k+1}^T(\alpha^d-\theta_k)$. In this model there is no need for a register with memory, since the instantaneous correction is fully absorbed on the next instant so that the following register value is given by:

$$r_k=e_k=u_k^T\lambda_k+\epsilon_k, \text{ if } |\lambda_k|\geq\bar{\lambda}$$

where $\epsilon_k\sim N(0,\sigma^2)$ and assuming an 'annoyance threshold' (vector) $\bar{\lambda}$ on $\lambda_t$ rather than $e_t$. The gain inference problem is written as an 'enhanced state space model':

$$\begin{cases} \theta_k=\theta_{k-1}+\lambda_{k-1}+v_k, & v_k-N(0,\delta^2 I) \\ \lambda_k=a^d-\theta_{k-1}+\omega_k, & \omega_k-N(0,\delta^2 I) \\ G_k=u_k^T\theta_k+\varepsilon_k, & \varepsilon_k-N(0,\sigma^2) \end{cases}$$

where $\delta^2 I$ is the covariance matrix of state noises $v_k$, $w_k$ and observation noise $\epsilon_k$ represents the user inconsistency. Note that the 'discount formula' for $e_k$ in Eq. (18) now shows up in the form $\lambda_k=a^d-\theta_{k-1}$, since incorporation of previous corrections in $\theta$ will diminish future $\lambda_k$. An auxiliary state variable $a_k$ is introduced to represent the unknown value of $a^d$. The linear dynamical system (LDS) formulation of Eq. (9) can be rewritten into $$\begin{cases} \begin{bmatrix}\theta_k\\ \lambda_k\\ a_k\end{bmatrix}=\begin{bmatrix} I & I & 0\\ -I & 0 & I\\ 0 & 0 & I\end{bmatrix}\begin{bmatrix}\theta_{k-1}\\ \lambda_{k-1}\\ a_{k-1}\end{bmatrix}+\xi_k \\ G_k=\begin{bmatrix}u_k^T\vec{0}\vec{0}\end{bmatrix}\begin{bmatrix}\theta_k\\ \lambda_k\\ a_k\end{bmatrix}+\varepsilon_k \end{cases}$$

where $\xi_k\sim N(0,\delta^2 I)$ represents the combined state noise and 0, $\vec{0}$ are a matrix and a vector of zeros of appropriate dimension, respectively. Re-labeling state vector and coefficients as $F_k$, $H_k$ and $x_k$, the familiar form for a time-varying LDS is recognized:

$$\begin{cases} x_k = H_k x_{k-1} + \xi_k, & \xi_k - N(0, \delta^2 I) \\ G_k = F_k x_k + \varepsilon_k, & \varepsilon_k - N(0, \sigma^2) \end{cases}$$

The Kalman filter update equations for this model are (cf. T. Minka, "From hidden Markov models to linear dynamical systems", Tech. Rep. 531, Dept. of Electrical Engineering and Computer Science, MIT, 1999):

$$\hat{x}_{k|k-1} = H_k \hat{x}_{k-1}$$

$$\Sigma_{k|k-1} = H_k \Sigma_{k-1} H_k^T + \delta^2 I$$

$$K_k = \Sigma_{k|k-1} F_k^T (F_k \Sigma_{k|k-1} F_k^T + \sigma^2)^{-1}$$

$$\Sigma_k = (I - K_k F_k) \Sigma_{k|k-1}$$

The update formula for $\hat{x}_k$ implies e.g. the update:

$$\hat{\theta}_k = \hat{\theta}_{k-1} + \hat{\lambda}_{k-1} + K_k^{(i)} \epsilon_k$$

where $K_k^{(i)}$ is the $i^{th}$ component (row) of $K_k$ and $\epsilon_k = G_k - \tilde{G}_k = G_k - F_k H_k \hat{x}_{k-1}$.

The learning mechanism can be applied to a wide range of applications. In general, assume that it is desired to control a process by a (scalar) control signal z(t), c.f. FIG. 6. For example, z(t) may be the (soft-switching) microphone control signal for a beamforming algorithm. u(t) is a $n_u$-dimensional vector of relevant features, such as speech-, music- and noise-presence probability estimators (or signal-to-noise ratio's). z(t) is realized as the sum of a (scalar) manual control signal e(t) and (the output of) a parameterized (scalar) control map $v_\theta(.)$, where θ is an $n_\theta$-dimensional vector of (adjustable) parameters. In another example, the learning mechanism is applied to the automatic selection of signal processing parameter start values upon turn-on of the hearing aid in accordance with recorded user preferences.

In the LVC example above, the control map was a simple linear map v(t)=θu(t), but in general the control map may be non-linear. As an example of the latter, the kernel expansion $v(t) = \Sigma_i \theta_i \times \Psi_i(u(t))$, where $\Psi_i(.)$ are the kernels, could form an appropriate part of a nonlinear learning machine. v(t) may also be generated by a dynamic model, e.g. v(t) may be the output of a Kalman filter or a hidden Markov model.

FIG. 7 is a block diagram of a system according to the present invention for learning to 'soft'-switch between one and two microphone inputs. In a prior art system, the control signal z(t), $0 \le z \le 1$, is a predetermined nonlinear function of speech and noise presence estimators. However, in the learning system according to the present invention, these (and maybe some other) estimators are collected in the feature vector u(t). The map from u(t) to the (proposed) control signal $v_\theta(t)$ is parameterized by θ. The volume wheel is now a 'microphone control'-wheel and can adjust the output control signal $z(t) = v_\theta(t) + e(t)$. Whenever a 'learning event' detector identifies 'explicit consent' at time $t_k$, the parameter vector θ absorbs some of the new information by means of a learning rule.

The method according to the present invention may also be applied for mapping the outputs of an environmental classifier onto control signals for certain algorithm parameters.

Further, the method may be applied for adjustment of noise suppression (PNR) minimal gain, of adaptation rates of feedback loops, of compression attack and release times, etc.

In general, any parameterizable map between (vector) input u and (scalar) output v can be learned through the volume wheel, if the 'explicit consent' moments can be identified. Moreover, sophisticated learning algorithms based on mutual information between inputs and targets are capable to select or discard components from the feature vector u in an online manner.

Experiments

Evaluation of Kalman Filter LVC

A Matlab simulation of the Kalman filter LVC was performed to study its behaviour with inconsistent users with changing preferences. As input a music excerpt was used that was pre-processed to give one-dimensional log-RMS feature vectors. This was fed to a simulated user who had a preference vector $a_t^d$ and noisy corrections based on the model of section 4.3 were fed back to the LVC.

Below it is assumed that the user has a fixed preferred $a^d$ of three (not shown in FIGS. 8-13). It is also assumed that the user was always in 'explicit dissent' mode, implying $\bar{\lambda}=0$. Learning is performed continuously from explicit consent, i.e. each correction was used for updating. The user inconsistency changed throughout the simulation (see FIG. 8, middle graph), where higher values of the inconsistency in a certain time segment denote more 'adjustment noise' in turning the virtual volume control. In FIG. 8, bottom 'alpha(t)' graph shows the roughly inverse scaling behaviour of implied learning rate $\mu_k$ (sometimes referred to in FIGS. 8-13 as $\alpha_t$) with user inconsistency, which is the desired robust behaviour.

The performance was studied with a user who now has changing amplification preferences and who experiences an annoyance threshold before making an adjustment, i.e. $\bar{\lambda}>0$. When adjustments are absent (i.e. when the AVC value comes close to the desired amplification level value $a^d$), the noise is also absent (see FIGS. 9 and 10, bottom 'user applied (noisy) volume control actions' graphs).

The results indicate a better tracking of user preference and much smaller sensitivity to user inconsistencies when the Kalman-based LVC is used compared to 'no learning'. This can be seen e.g. by comparing the top rows of FIGS. 9 (without learning) and 10 (LVC): the LVC 'output' signal $y_t$ (in log-RMS values) is much more smooth than the 'no learning' output, indicating less sensitivity to user inconsistencies. Furthermore, it should be noted in the bottom row of FIG. 4 that using the LVC results in less adjustments made by the user, another desirable feature of the LVC algorithm.

Real Time Simulation

The LVC algorithms were implemented on a real time platform, where subjects are allowed to interact with the algorithm in real time, in order to study the behaviour of the algorithms and the user. To start with the user was a simulated user, i.e. the adjustment sequence was predetermined and the behaviour of the algorithms was studied.

nLMS

In the top graph of FIG. 11, the predetermined sequence of noisy user corrections (i.e. $\{e_k\}$) are plotted. The results with a slowly responding LVC (not shown) are that the estimated learning rate ("mu") scales roughly inversely with the noisy adjustments. However, two 'informative' adjustments are considered noise, and lead to a sudden decrease of the learning rate, which is undesirable. This effect is also present in a fast responding LVC (FIG. 11), although the 'recovery' of this undesirable drop is faster. The algorithm's response to the noisy adjustment episodes is also quite noisy (fast changes in learning rate due to noisy actions). Note that nLMS may easily 'see' a short sequence of informative adjustments as noise, increasing the estimate of $\sigma_k$ and decreasing the learning rate, which is undesirable.

Kalman Filter

In FIGS. 12 and 13, the behaviour of the enhanced and the simplified Kalman filter LVC are compared in a setting with relative volume control usage, i.e. with adjustment sequences $\{extvol_k\}=\{e_k\}$. It is noticed that the enhanced Kalman filter LVC estimated the noise in the adjustments rather nicely (in the observation noise variable $\sigma_k$). With the simplified Kalman LVC, the desired behaviour is now observed with the adjustment sequence that was used earlier in the nLMS experiments. Although the observation noise seems to be 'pulled up' along with the state noise (which could be a result of our suboptimal estimation of state noise and observation noise), the learning rate alpha is high at the two transition points (informative adjustments around 0.25E4 and 3E4) and mainly low at the noisy adjustments. The relatively high learning rate at the end of the sequence appears an artefact of the overestimation of the observation noise. A better way to estimate state and observation noise (e.g. with recursive EM) may overcome this.

Evaluation With a Listening Test

A listening test was set up to study the user's volume control behaviour. The simplified Kalman LVC was selected and implemented on the real time platform and used two acoustic features and a bias term. Then several speech and noise snapshots were picked from a database (typically in the order of 10 seconds) and these were combined in several ratios and appended. This led to 4 streams of signal/noise episodes with different types of signal and noise in different ratios. Eight normal hearing volunteers were asked to listen to these four streams twice in a row, adjusting the volume when desired (referred to as one experiment with two runs). Two volunteers were assigned to the no learning situation, three were assigned to the learning situation and three were assigned to both. The volunteers were not told whether learning took place in their experiment or not. In the no learning case, the algorithmic behaviour in the first run of four streams and the second run of four streams are identical (i.e. no learning takes place, so the settings of the automatic volume control remain at their initial values). In the learning case, user corrections are incorporated in the internal volume control throughout the experiment.

Results

In 9 out of 11 experiments, the total number of adjustments in the second run of four streams decreased compared to the first run. This can probably be explained by a certain 'getting used to' or accommodation effect (perhaps a 'tiredness of adjusting the volume'). This effect typically gives rise to a reduction to around 80% adjustments. The percentages refer to the number of adjustments in the second run as a percentage of the number of adjustments in the first run. This figure was obtained by averaging the second run percentages of the five control experiments. In the six learning experiments, an average second run percentage around 80% was found as well, but a large variance was also found in the 'turning behaviour' (two out of six had second run percentages larger than 100, three out of six had second run percentages around 50). However, when only considering the three subjects who experienced both LVC and no learning, the total number of adjustments in both runs of an experiment appeared to decrease when the LVC was present. When the number of adjustments in an experiment for no learning is set to 100%, LVC led to some 80% adjustments, on average. Four out of six 'learning subjects' reported 'a pleasant effect of the LVC'. One of these preferred the LVC run since "no noticeable deteriorations were present, and some of the sharp and annoying transitions were smoothed out".

FURTHER EMBODIMENTS

In one exemplary embodiment, the method is utilized to adjust parameters of a comfort control algorithm wherein adjustment of e.g. the volume wheel or a slider on e.g. a remote control is utilized to interpolate between two extreme settings of (an) algorithm(s), e.g. one setting that is very comfortable (but unintelligible), and one that is very intelligible (but uncomfortable). The typical settings of the 'extremes' for a particular patient (i.e. the settings for 'intelligible' and 'comfortable' that are suitable for a particular person in a particular situation) are assumed to be known, or can perhaps be learned as well. The user 'walks over the path between the end points' by using volume wheel or slider in order to set his preferred trade-off in a certain environmental condition. The Learning Comfort Control will learn the user-preferred trade-off point (for example depending on then environment) and apply consecutively.

In one exemplary embodiment, the method is utilized to adjust parameters of a tinnitus masker.

Some tinnitus masking (TM) algorithms appear to work sometimes for some people. This uncertainty about its effectiveness, even after the fitting session, makes a TM algorithm suitable for further training though on-line personalization. A patient who suffers from tinnitus is instructed during the fitting session that the hearing aid's user control (volume wheel, push button or remote control unit) is actually linked to (parameters of) his tinnitus masking algorithm. The patient is encouraged to adjust the user control at any time to more pleasant settings. An on-line learning algorithm, e.g. the algorithms that are proposed for LVC, could then absorb consistent user adjustment patterns in an automated 'TM control algorithm', e.g. could learn to turn on the TM algorithm in quiet and turn off the TM algorithm in a noisy environment. Patient preference feedback is hence used to tune the parameters for a personalized tinnitus masking algorithm.

The person skilled in the art will recognize that any parameter setting of the hearing aid may be adjusted utilizing the method according to the present invention, such as parameter(s) for a beam width algorithm, parameter(s) for a AGC (gains, compression ratios, time constants) algorithm, settings of a program button, etc.

In one embodiment of the invention, the user may signal dissent using the user-interface, e.g. by actuation of a certain button, a so-called dissent button, e.g. on the hearing aid housing or a remote control.

This is a generic interface for personalizing any set of hearing aid parameters. It can therefore be tied to any of the 'on-line learning' embodiments. It is a very intuitive interface from a user point of view, since the user expresses his discomfort with a certain setting by pushing the dissent button, in effect making the statement: "I don't like this, try something better". However, the user does not say what the user would like to hear instead. Therefore, this is a much more challenging interface from an learning point of view. Compare e.g. the LVC, where the user expresses his content with a certain setting (after having turned the volume wheel to a new desirable position), so the learning algorithm can use this new setting as a 'target setting' or a 'positive example' to train on. In the LDB the user only provides 'negative examples' so there is no information about the direction in which the parameters should be changed to achieve a (more) favourable setting.

As an example, the user walks around, and expresses dissent with a certain setting in a certain situation a couple of times. From this 'no go area' in the space of settings, and algorithm called Learning Dissent Button estimates a better setting that is applied instead. This could again (e.g. in certain acoustic environments) be 'voted against' by the user by pushing the dissent button, leading to a further refinement of the 'area of acceptable settings'. Many other ways to learn from a dissent button could also be invented, e.g. by toggling through a predefined set of supposedly useful but different settings.

In one embodiment of the invention, parameter adjustment may also or only be performed during a fitting session. For example, the PNR depth vector D may be adjusted during a fitting session in accordance with the Bayesian incremental fitting method according to the present invention. This may involve a paired comparison setup, where the listening experiments are chosen by the experimenter (e.g. the dispenser), and it requires the presence of a patient utility model, parameters of which are to be learned as well.

In an example, one overall PNR depth parameter was fitted for a particular user. The (continuous) parameter was discretized into 16 levels, leading to 16 candidate values $\theta_k$, for $k=0, \ldots, 15$ which correspond to $0, \ldots, 15$ dB gain depth. For the utility model $U(v(y); \omega)$, the so-called Coherence Speech Intelligibility Index (CSII) disclosed in "Coherence and the Speech Intelligibility Index" by James M. Kates (GN ReSound) and Kathryn Arehart (Univ. of Colorado, Boulder), *The Journal of the Acoustical Society of America*, May 2004, Volume 115, Issue 5, p. 2604 was used as a basis. This index uses three acoustic features $v_i(y)$ from which a weighted sum is computed. The weights in the weighted sum are now personalized, i.e. our utility model was $$U(v(y);\omega)=\Sigma_{i=1}^{3}\omega i v i(y)$$

and the weights $\omega_i$ were inferred. A sound library of 30 sound samples was used in this experiment. The integrals for computing the expected value given perfect information $EV|PI_n(e)$ were performed with Monte Carlo integration. The updated posterior over the user-specific weights $\omega$ was obtained with a Gaussian particle filter. The experimenter was subjected to a large set of listening experiments, where each next optimal experiment in the sequence was chosen by the Bayesian method described in this patent. The experimenter's feedback used to update the posterior over the user-specific weights using the Bayesian method described in this patent. In the FIG. 15, the expected expected utility EEU of each parameter setting $\theta_k$ is displayed and it should be noted that there is a clear preference for parameter value $\theta_7=7$ dB. The sound library consisted of speech samples mixed with stationary and non-stationary noise samples.

In a different experiment, the sound library consisted of speech samples mixed with stationary noise only. FIG. 16 shows the results of that experiment. In the top graph the expected expected utility of each parameter setting $\theta_k$ is again shown, where it is clear that higher levels are more preferred by the experimenter than lower levels. However, the peak in the user preference (at the specific value of 13 dB) is much less pronounced than before. The bottom graph shows the differential entropy of the weights $H(\omega)$ (which indicates the uncertainty about the weights) as a function of the number of listening experiments. Performing more listening experiments generally decreases the uncertainty about the weights. FIG. 16 also shows the graphical user interface which allows for experimenting with different settings for the utility model, experiment selection method, etc. For example, as a benchmark to the proposed Bayesian method, a heuristic selection procedure based on a knockout tournament can be chosen. Results indicate that optimal Bayesian experiment selection outperforms knockout or random selection of experiments.

The push button can be used e.g. to switch between programs (which will be learned by a 'Learning Program Button' algorithm) or to express discomfort with a certain setting of the hearing aid (which will be learned by a 'Learning Dissent Button' algorithm).

The invention claimed is:

1. In a hearing aid with a library of signal processing algorithms F, a method of configuring the hearing aid comprising:

extracting a signal feature of a signal in the hearing aid;

recording in the hearing aid a first input representing a first response, wherein the first input is resulted from a user of the hearing aid operating a control associated with the hearing aid, configuring the hearing aid based on the recorded first input, wherein the act of configuring the hearing aid based on the recorded first input involves a set of signal processing parameter(s);

recording in the hearing aid a second input representing a second response, wherein the second input is resulted from the user operating the control associated with the hearing aid; and configuring the hearing aid based on the second input;

wherein each of the acts of configuring the hearing aid comprises performing a computation by the hearing aid based on a Bayesian inference;

wherein the act of recording the first input comprises recording a measure of an adjustment of the hearing aid that is resulted from the user operating the control; and wherein the act of configuring the hearing aid based on the recorded first input is performed by a processing unit in the hearing aid based on the signal feature, a learning parameter, and the measure of the adjustment.

2. The method according to claim 1, further comprising recording the user's $k^{th}$ decision $d^k$ in response to a signal $x^k$, and updating $P(\omega)$ in accordance with $$P(\omega|D^k)\propto P(d^k|x^k,\omega)P(\omega|D^{k-1}), \text{ and}$$

calculating a new optimum $\theta_k^*$ in accordance with $$\theta_k^* = \arg\max_{\theta} \sum_n P(x_n) \int_\omega U(x_n, \theta, \omega) P(\omega \mid D^k)\, d\omega,$$

wherein $U(y;\omega)$ is a user satisfaction model, $P(\omega)$ is an uncertainty about model parameters $\omega$ y is a processed signal $F(x,\Theta)$, F is the library of hearing aid signal processing algorithms, $\Theta$ is an algorithm parameter space, $x_n$ is a set of n input signals, $P(x_n)$ is an input signal probability function, and $D^i=\{d^1, d^2, \ldots, d^i\}$ is a set of recorded user decisions from decision 1 to i.

3. The method according to claim 1, further comprising recording the user's $k^{th}$ decision $d^k$ in response to a signal $x^k$, and updating $P(\omega)$ in accordance with $$P(\omega|D^k,\alpha)\propto P(d^k|\omega)P(\omega|D^{k-1},\alpha),$$

and calculating a new optimum $\theta_k^*$ in accordance with $$\theta_k^* = \arg\max_{\theta} \sum_n P(x_n) \int_\omega U(x_n, \theta, \omega) P(\omega \mid D^k, \alpha)\, d\omega$$

wherein $\alpha$ is an auditory profile of the user, $U(y;\omega)$ is a user satisfaction model, $P(\omega)$ is an uncertainty about model parameters $\omega$ y is a processed signal $F(x,\Theta)$, F is the library of hearing aid signal processing algorithms, $\Theta$ is an algorithm parameter space, $x_n$ is a set of n input signals, $P(x_n)$ is an input signal probability function, and $D^i=\{d^1, d^2, \ldots, d^i\}$ is a set of recorded user decisions from decision 1 to i.

4. The method according to claim 3, wherein the auditory profile $\alpha$ of the user is recorded during an initial fit of the hearing aid to the user.

5. The method according to claim 1, comprising performing an initial fit of the hearing aid to the user including:

recording auditory profile $\alpha_0$ of the user, and calculating $$\theta_0^* = \arg \max_{\theta} \sum_n P(x_n) \int_\omega U(x_n; \theta, \omega) P(\omega \mid \alpha_0) d\omega$$

$\theta_0$* constituting a set of, on the average, best perceived algorithm parameters by users with the auditory profile $\alpha_0$, and wherein $U(y;\omega)$ is a user satisfaction model, $P(\omega)$ is an uncertainty about model parameters $\omega$ y is a processed signal $F(x,\Theta)$, F is the library of hearing aid signal processing algorithms, $\Theta$ is an algorithm parameter space, $x_n$ is a set of n input signals, and $P(x_n)$ is an input signal probability function.

6. The method according to claim 5, further comprising recording a user's preference $d^k$ and updating $P(\omega)$ in accordance with $$P(\omega|D^k,\alpha_0) \propto P(d^k|e^k,\omega) P(\omega|D^{k-1},\alpha_0),$$

where $e^k$ is an experiment tuple $e^k=\{x^k, \theta_1^k, \theta_2^k\}$, where $\theta_1^k$ and $\theta_2^k$ are two admissible parameter vector values, and calculating a new optimum $\theta_k$* in accordance with $$\theta_k^* = \arg \max_{\theta} \sum_n P(x_n) \int_\omega U(x_n; \theta, \omega) P(\omega \mid D^k \alpha_0) d\omega.$$

7. The method according to claim 6, further comprising selecting the $k^{th}$ experiment tuple, and determining $e^k$ that maximizes a Value of Perfect Information based on:

$$e^k = \arg \max_e VPI^k(e).$$

8. The method according to claim 1, wherein the act of updating the hearing aid includes data exchange through a computer network.

9. The method according to claim 1, further comprising absorbing a user corrective adjustment of the hearing aid using a normalized Least-Mean-Squares algorithm.

10. The method according to claim 1, wherein the act of configuring the hearing aid based on the recorded first input comprises (1) determining z by the equation: $z=u\theta+r$, wherein $\theta$ is a learning parameter set, u is the signal feature, and r is the recorded measure, and (2) absorbing the user adjustment e in $\theta$ by the equation:

$$\theta_N=\phi(u,r)+\theta_P$$

wherein $\theta_N$ comprises new values of the learning parameter set $\theta$, $\theta_P$ comprises previous values of the learning parameter set $\theta$, and $\phi$ is a function of the signal feature u and the recorded measure r.

11. The method according to claim 10, wherein $\phi$ forms a normalized Least Mean Squares algorithm.

12. The method according to claim 10, wherein $\phi$ forms a recursive Least Squares algorithm.

13. The method according to claim 10, wherein $\phi$ forms a Kalman filtering algorithm.

14. The method according to claim 10, wherein $\phi$ forms a Kalman smoothing algorithm.

15. The method according to claim 10, wherein z is a one-dimensional variable g, the signal feature u is a matrix, and wherein the user adjustment is a one-dimensional variable e that is absorbed in $\theta$ by the equation:

$$\underline{\theta}_N = \frac{\mu}{\sigma^2 + \underline{u}^T \underline{u}} \underline{u}^T r + \underline{\theta}_P$$

wherein $\mu$ is a step size.

16. The method according to claim 15, further comprising calculating a new recorded measure $r_N$ of the user adjustment e by the equation:

$$r_N=r_P-\underline{u}^T\underline{\theta}_P+e$$

wherein $r_P$ is a previous recorded measure, and e is the user adjustment.

17. The method according to claim 16, further comprising calculating a new value $\sigma_N$ of a user inconsistency estimator $\sigma^2$ by the equation:

$$\sigma_N^2=\sigma_P^2+\gamma[r_N^2-\sigma_P^2]$$

wherein $\sigma_P$ is a previous value of the user inconsistency estimator, and $\gamma$ is a constant.

18. The method according to claim 15, wherein the one-dimensional variable g is determined based on the following equation:

$$g=\underline{u}^T\underline{\theta}+r.$$

19. The method according to claim 10, wherein z is a one-dimensional variable g, and $$g=\underline{f}^T\underline{\phi}+W$$

where f is a vector that contains u, $\phi$ is a vector that contains $\theta$, and w is a noise value with variance VUS, and wherein $\phi$ is non-stationary and follows the model $\phi_N=G\phi_P+v$, where G is a matrix, v is a noise vector with variance VPHI, and the $\theta$ is learned with an algorithm based on Kalman filtering, according to the update equations $$\phi_{predicted}^{mean}=G\phi_{previous}^{mean}$$

$$\phi_{predicted}^{covariance}=G\phi_{previous}^{covariance}G^T+VPHI$$

$$K=\phi_{predicted}^{covariance}f(f^T\phi_{predicted}^{covariance}f+VUS)^{-1}$$

$$\phi_{next}^{mean}=\phi_{predicted}^{mean}+K(g-f^T\phi_{predicted}^{mean})$$

$$\phi_{next}^{covariance}=(I-KfT)\phi_{predicted}^{covariance}$$

wherein $\phi_{predicted}^{mean}$ the predicted mean of state vector $\phi$ at a certain time $t_k$, $\phi_{predicted}^{covariance}$ is the predicted covariance of the state vector $\phi$ at the time $t_k$, K is the Kalman gain at time $t_k$, $\phi_{next}^{mean}$ is the updated mean of state vector $\phi$ at a the time $t_k$, and $\phi_{next}^{covariance}$ is the updated covariance of state vector $\phi$ at the time $t_k$.

20. The method according to claim 1, where the user adjusts a user control in order to interpolate between two different settings of the hearing aid.

21. The method according to claim 1, further comprising classifying the signal feature.

22. The method according to claim 1, where the user adjustment is recorded at a time of explicit dissent.

23. The method according to claim 1, where the user adjustment is recorded at a time of explicit consent.

24. A hearing aid with the processing unit of claim 1, wherein the hearing aid is adapted for digital signal processing in accordance with the method according to claim 1.

25. The hearing aid according to claim 24, wherein the processing unit is further adapted for volume control.

26. The hearing aid according to claim 24, wherein the processing unit is further adapted for switching between an omni-directional and a directional microphone characteristic.

27. The hearing aid according to claim 24, wherein the processing unit is further adapted for automatic selection of signal processing parameter start values upon turn-on of the hearing aid.

28. The hearing aid according to claim 24, further comprising a user-interface for inputting user dissent for learning control of the hearing aid.

29. The hearing aid according to claim 28, wherein the user-interface comprises a push-button for inputting user dissent.

30. A method of configuring a hearing aid, comprising:

obtaining a signal feature of a signal;

obtaining a first response that represents a first preference of a user of the hearing aid operating a control associated with the hearing aid, wherein the act of obtaining the first response is performed by the hearing aid;

updating the hearing aid based on the first response;

obtaining a second response that represents a second preference of the user after the hearing aid is updated based on the first response; and updating the hearing aid based on the second response;

wherein each of the acts of updating the hearing aid comprises performing a calculation based on Bayesian inference;

wherein the first response is represented by a measure of an adjustment of the hearing aid; and wherein the act of updating the hearing aid based on the first response is performed by a processing unit in the hearing aid based on the signal feature, a learning parameter, and the measure of the adjustment.

31. The method according to claim 30, wherein the acts of updating the hearing aid comprise data exchange through a computer network.

32. The method according to claim 30, further comprising absorbing a corrective adjustment by the user.

33. The method according to claim 32, wherein that act of absorbing is performed using a Least-Mean-Squares algorithm.

34. The method according to claim 33, wherein the Least-Mean-Squares algorithm comprises a normalized Least-Mean-Squares algorithm.

35. The method according to claim 30, wherein the act of updating the hearing aid based on the first response comprises updating a processing algorithm in the hearing aid.

36. The method according to claim 35, wherein the act of updating the processing algorithm comprises updating a set of parameters for the processing algorithm.

37. A hearing aid with the processing unit of claim 30, wherein the hearing aid is adapted for digital signal processing in accordance with the method according to claim 30.

38. The method of claim 30, wherein the act of obtaining the first response, the act of updating the hearing aid based on the first response, the act of obtaining the second response, and the act of updating the hearing aid based on the second response, are performed while the hearing aid is outside a dispenser's office.

39. The method of claim 30, wherein the act of obtaining the first response, the act of updating the hearing aid based on the first response, the act of obtaining the second response, and the act of updating the hearing aid based on the second response, are performed while the user is using the hearing aid on a daily basis.

40. The method of claim 30, wherein the first response comprises an input from a control wheel, a push-button, a remote control, the Internet, or a tap-control at a hearing aid housing of the hearing aid.

41. A method of configuring a hearing aid, comprising:

obtaining a signal feature of a signal;

obtaining a first input that represents a first preference of a user of the hearing aid operating a control associated with the hearing aid;

updating the hearing aid based on the first input;

obtaining a second input that represents a second preference of the user after the hearing aid is updated based on the first input; and updating the hearing aid based on the second input;

wherein each of the acts of updating the hearing aid comprises performing a calculation based on Bayesian inference; and wherein the act of obtaining the first input, the act of updating the hearing aid based on the first input, the act of obtaining the second input, and the act of updating the hearing aid based on the second input, are performed while the hearing aid is outside a dispenser's office;

wherein the first response is represented by a measure of an adjustment of the hearing aid; and wherein the act of updating the hearing aid based on the first response is performed by a processing unit in the hearing aid based on the signal feature, a learning parameter, and the measure of the adjustment.

42. The method of claim 41, wherein the acts of updating the hearing aid comprise data exchange through a computer network.

43. The method of claim 41, wherein the adjustment comprises a corrective adjustment made by the user of the hearing aid.

44. The method of claim 43, further comprising processing the corrective adjustment, wherein that act of processing the corrective adjustment is performed using a Least-Mean-Squares algorithm.

45. The method of claim 44, wherein the Least-Mean-Squares algorithm comprises a normalized Least-Mean-Squares algorithm.

46. The method of claim 41, wherein the act of updating the hearing aid based on the first input comprises updating a processing algorithm in the hearing aid.

47. The method of claim 46, wherein the act of updating the processing algorithm comprises updating a set of parameters for the processing algorithm.

48. The method of claim 41, wherein the act of obtaining the first input, the act of updating the hearing aid based on the first input, the act of obtaining the second input, and the act of updating the hearing aid based on the second input, are performed while the user is using the hearing aid on a daily basis.

49. The method of claim 41, wherein the control comprises a control wheel, a push-button, or a tap-control.

50. The method of claim 41, wherein the first input is generated using the control at the hearing aid.

51. The method of claim 41, wherein the control comprises a remote control.

52. The method of claim 41, wherein the first input is generated using the Internet.

53. A hearing aid having the processing unit of claim 41, wherein the hearing aid is configured for digital signal processing in accordance with the method according to claim 41.

* * * * *